US012721397B2

(12) United States Patent
Danby et al.

(10) Patent No.: US 12,721,397 B2
(45) Date of Patent: Sep. 1, 2026

(54) KNITTED COMPONENTS AND ARTICLES FOR IMPROVED BALL CONTROL AND DURABILITY

(71) Applicant: NIKE, Inc., Beaverton, OR (US)

(72) Inventors: Nicola Danby, London (GB); Mohamed Mohamed, Beaverton, OR (US); Arthur Parker Molinari, Portland, OR (US); Brian G. Prevo, Portland, OR (US); Batiste Remy, Portland, OR (US); Wil Sixour, Tigard, OR (US); Alan Wight, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/691,663

(22) PCT Filed: Sep. 15, 2021

(86) PCT No.: PCT/US2021/050495
§ 371 (c)(1),
(2) Date: Mar. 13, 2024

(87) PCT Pub. No.: WO2023/043438
PCT Pub. Date: Mar. 23, 2023

(65) Prior Publication Data

US 2024/0277103 A1 Aug. 22, 2024

Related U.S. Application Data

(60) Provisional application No. 63/244,121, filed on Sep. 14, 2021.

(51) Int. Cl.
*A43B 1/04* (2022.01)
*A43B 23/02* (2006.01)
(Continued)

(52) U.S. Cl.
CPC ..... *A43B 1/04* (2013.01); *A43B 23/0215* (2013.01); *D04B 1/102* (2013.01); *D04B 1/24* (2013.01); *D10B 2501/043* (2013.01)

(58) Field of Classification Search
CPC ... A43B 1/04; A43B 23/0205; A43B 23/0215; A43B 23/0225; A43B 23/0265;
(Continued)

(56) References Cited

U.S. PATENT DOCUMENTS 4,616,432 A 10/1986 Bunch et al.
4,785,558 A 11/1988 Shiomura
(Continued)

FOREIGN PATENT DOCUMENTS

CN 103989291 A 8/2014
CN 104106883 A 10/2014
(Continued)

OTHER PUBLICATIONS

"Shore Hardness and Soft TPEs" by Teknor Apex, https://www.teknorapex.com/en-us/resources/blogs/thermoplastic-elastomers-and-measuring-shore-hardness-chart, Sep. 19, 2017.*
(Continued)

*Primary Examiner* — Jenna L Johnson
(74) *Attorney, Agent, or Firm* — Shook, Hardy & Bacon L.L.P.

(57) ABSTRACT

A knitted component with a surface that includes first areas and second areas having different relative coefficient of frictions and formed in an alternating pattern. The first areas of the first surface are 40% to 80% of the total surface area for the first surface. The alternating pattern may be in the form of concentric shapes. The alternating pattern may have linear boundaries and curvilinear boundaries between first
(Continued)

areas and second areas. The first areas can be formed from a first yarn having a core and a coating. The coating at least partially surrounds the core.

24 Claims, 6 Drawing Sheets

(51) Int. Cl.
*D04B 1/10* (2006.01)
*D04B 1/24* (2006.01)

(58) Field of Classification Search
CPC ..... D10B 2501/043; D04B 1/12; D04B 1/14; D04B 1/16; D04B 1/18; D04B 1/22; D06C 23/00; D06C 23/04; D06Q 1/08
See application file for complete search history.

(56) References Cited

U.S. PATENT DOCUMENTS

| | | | | |
|---|---|---|---|---|
| 5,276,983 | A | 1/1994 | Hatfield | |
| 5,385,036 | A | 1/1995 | Spillane et al. | |
| D430,969 | S | 9/2000 | Portaud et al. | |
| 6,449,879 | B1 | 9/2002 | Fallon et al. | |
| 6,523,282 | B1 | 2/2003 | Johnston | |
| 7,140,128 | B2 | 11/2006 | Huckle | |
| 7,543,397 | B2 | 6/2009 | Kilgore et al. | |
| D654,255 | S | 2/2012 | Amzallag | |
| 8,516,721 | B2 | 8/2013 | Mahoney | |
| 8,745,901 | B2 | 6/2014 | Toraya | |
| 8,997,529 | B1 | 4/2015 | Podhajny | |
| 9,713,357 | B2 | 7/2017 | Denison et al. | |
| 9,839,254 | B2 | 12/2017 | Stauffer et al. | |
| 9,918,514 | B2 | 3/2018 | Droege et al. | |
| 9,968,156 | B2 | 5/2018 | Huffman et al. | |
| 10,092,065 | B2 | 10/2018 | Rushbrook et al. | |
| D838,958 | S | 1/2019 | Galway et al. | |
| 10,736,382 | B2 | 8/2020 | Hatfield et al. | |
| D902,571 | S | 11/2020 | Workman et al. | |
| 10,856,619 | B2 | 12/2020 | Fuerst, Sr. | |
| 11,140,941 | B2 | 10/2021 | Xanthos et al. | |
| 2005/0115284 | A1 | 6/2005 | Dua | |
| 2008/0078102 | A1 | 4/2008 | Kilgore et al. | |
| 2010/0299967 | A1 | 12/2010 | Atsumi et al. | |
| 2011/0197475 | A1 | 8/2011 | Weidl et al. | |
| 2014/0310984 | A1 | 10/2014 | Tamm et al. | |
| 2015/0246776 | A1 | 9/2015 | Shoji et al. | |
| 2015/0250256 | A1 | 9/2015 | Podhajny | |
| 2016/0058100 | A1 | 3/2016 | Dealey et al. | |
| 2016/0227881 | A1 | 8/2016 | Beers et al. | |
| 2018/0125165 | A1 | 5/2018 | Adami et al. | |
| 2018/0127905 | A1* | 5/2018 | Amis | D04B 21/12 |
| 2018/0132558 | A1 | 5/2018 | Berrian et al. | |
| 2018/0310671 | A1 | 11/2018 | Soderberg et al. | |
| 2019/0208862 | A1 | 7/2019 | Poegl et al. | |
| 2019/0231021 | A1 | 8/2019 | Hoying et al. | |
| 2019/0328075 | A1 | 10/2019 | Poulsen et al. | |
| 2019/0350284 | A1* | 11/2019 | Morgan | B32B 3/28 |
| 2020/0375317 | A1 | 12/2020 | Meir | |
| 2021/0022445 | A1 | 1/2021 | Dua et al. | |
| 2021/0030108 | A1* | 2/2021 | Frazier | A43B 23/0225 |
| 2021/0030109 | A1* | 2/2021 | Frazier | A43B 1/14 |
| 2021/0030115 | A1* | 2/2021 | Frazier | A43B 23/0235 |
| 2021/0030117 | A1* | 2/2021 | Frazier | D04B 1/16 |
| 2021/0337933 | A1 | 11/2021 | Fallon et al. | |
| 2022/0326410 | A1 | 10/2022 | Bee et al. | |
| 2023/0087149 | A1 | 3/2023 | Danby et al. | |
| 2025/0280917 | A1 | 9/2025 | Tamm | |

FOREIGN PATENT DOCUMENTS

| | | | | | |
|---|---|---|---|---|---|
| CN | 104334043 | A | | 2/2015 | |
| CN | 204292338 | U | | 4/2015 | |
| CN | 206586496 | U | | 10/2017 | |
| CN | 108135328 | A | * | 6/2018 | A43B 1/04 |
| CN | 111455536 | A | | 7/2020 | |
| JP | 2016-073627 | A | | 5/2016 | |
| JP | 2020-147867 | A | | 9/2020 | |
| KR | 10-2020-0067154 | A | | 6/2020 | |
| WO | WO2013151968 | A2 | | 10/2013 | |
| WO | 2015/101631 | A1 | | 7/2015 | |
| WO | WO2018089501 | A1 | | 5/2018 | |
| WO | 2020/018883 | A1 | | 1/2020 | |
| WO | 2020/033794 | A1 | | 2/2020 | |
| WO | 2020/214450 | A1 | | 10/2020 | |
| WO | WO2021026033 | A1 | | 2/2021 | |
| WO | 2021/142251 | A1 | | 7/2021 | |

OTHER PUBLICATIONS

English Translation CN 108135328 (Year: 2018).*

Dwyer, Ross, "Nike Joyride NSW Setter", Sneakernews.com, Available online at <https://sneakernews.com/2019/08/08/nike-joyride-nsw-setter-pure-platinum-at6395-100-release-info/>, Accessed on Aug. 1, 2023, Aug. 8, 2019, 7 pages.

Lim et al., "Brooks Levitate 5, Levitate GTS 5 StealthFit and Levitate 5 StealthFit Multi Tester Reviews", Roadtrailrun.com, Available online at <https://www.roadtrailrun.com/2021/07/brooks-levitate-5-levitate-gts-5.html>, Accessed on Aug. 1, 2023, Jul. 28, 2021, 26 pages.

Nike New Balance Tekela v3+ Pro FG, prodirectsport.com, Available online at <https://www.prodirectsport.com/ soccer/p/new-balance-tekela-3-pro-fg-alpha-pink-horizon-mens-boots-247639/>, Accessed on Aug. 1, 2023, 5 pages.

Nike Phantom GT2 Dynamic Fit Elite FG, Nike.com, Available online at <https://www.nike.com/in/t/phantom-gt2-dynamic-fit-elite-fg-football-boots-c2H8s5>, Accessed on Aug. 1, 2023, 4 pages.

Nike Speed Skin Fit, Available online at <https://www.amazon.com/Nike-Vapor-Elite-Black-Gold/dp/B07FKKCSRG/ref=sr_1_1crid=2DQ9LX0G6Z5UD&keywords=Nike%2BVapor%2B13%2BElite&qid=1648055244&sprefix=nike%2Bvapor%2B 13%2Belite%2Caps%2C79&sr=8-1&th=1>, Accessed on Aug. 1, 2023, 6 pages.

Non-Final Office Action received for U.S. Appl. No. 17/944,803, mailed on Sep. 5, 2024, 13 pages.

Non-Final Office Action received for U.S. Appl. No. 18/204,110, mailed on Dec. 5, 2024, 17 pages.

Puma evoKNIT, Available at<https://www.amazon.com/PUMA-Womens-Botas-f%C3%BAtbol-Verde/dp/B07SBWB8FQ/ref=sr_1_12?asc=1&c=ts&keywords=Women%27s%2BSoccer% 2BShoes&qid=1648054778&refinements=p_n_size_browse-vebin%3A1285137011&s=apparel&sr=1-12&ts_id=679370011&th=1&psc=1>, Accessed on Aug. 1, 2023, 5 pages.

Final Office Action received for U.S. Appl. No. 17/944,803, mailed on Feb. 27, 2025, 12 pages.

Extended European Search Report received for European Patent Application No. 25186164.7, mailed on Sep. 26, 2025, 11 pages.

Final Office Action received for U.S. Appl. No. 18/204,110, mailed on Apr. 24, 2025, 15 pages.

Non-Final Office Action received for U.S. Appl. No. 17/944,803, mailed on Jul. 1, 2025, 13 pages.

Non-Final Office Action received for U.S. Appl. No. 18/204,110, mailed on Oct. 20, 2025, 17 pages.

Final Office Action received for U.S. Appl. No. 17/944,803, mailed on Jan. 13, 2026, 11 pages.

* cited by examiner

KNITTED COMPONENTS AND ARTICLES FOR IMPROVED BALL CONTROL AND DURABILITY

CROSS REFERENCE TO RELATED APPLICATIONS

This non-provisional patent application is a 35 U.S.C. 371 national phase application of PCT/US2021/050495 (filed Sep. 15, 2021), which claims priority to U.S. provisional patent application No. 63/244,121, filed Sep. 14, 2021, titled "KNITTED COMPONENTS AND ARTICLES FOR IMPROVED BALL CONTROL AND DURABILITY," which are incorporated by reference herein in their entirety.

FIELD OF THE INVENTION

The present disclosure is directed to knitted textiles, components of articles, and articles, such as articles of footwear, and methods of making the same.

BACKGROUND OF THE INVENTION

A variety of articles, including footwear, are formed of textiles, which are often formed by interlooping (e.g., knitting) a yarn or plurality of yarns. In particular, an upper for an article of footwear may be formed from a knitted textile. To increase durability and/or water resistance, non-textile components may be added and secured (e.g., glued, stitched) to the textile. For example, crosslinked polyurethanes can be used as durable covering layers, synthetic leather textiles, or laminate film layers. However, the addition of any additional layer, even a film, reduces the ability of the article to conform to a wearer and provide proprioceptive feedback, which can be particularly important for articles in certain sporting activities. In an article of footwear for football (also known in other geographical areas as soccer), for example, it may be important for a wearer to be able to feel the ball through the textile as well as to have certain levels of traction or grip for ball control and handling. At the same time, too much grip in the footwear may interfere with the wearer's ability to perform quick touches and ball-handling maneuvers.

BRIEF DESCRIPTION OF THE DRAWING

Further aspects of the present disclosure will be readily appreciated upon review of the detailed description, described below, when taken in conjunction with the accompanying drawings.

DETAILED DESCRIPTION OF THE INVENTION

Figure 1A:
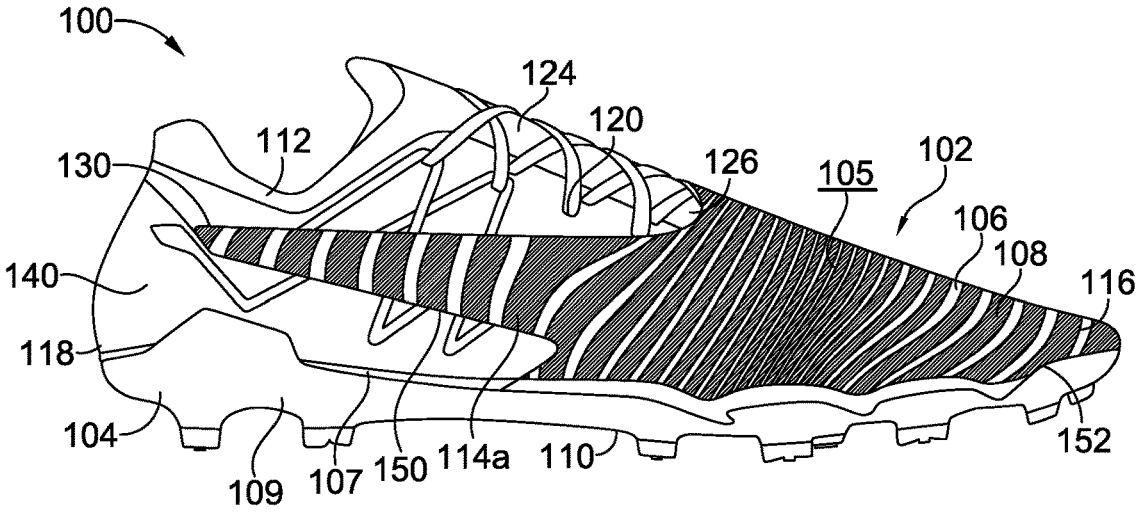
FIG. 1A is a lateral side perspective view of an article of footwear in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

A variety of articles, including footwear, are formed of textiles, which are often formed by interlooping (e.g., knitting) a yarn or plurality of yarns. In particular, an upper for an article of footwear may be formed from a knitted textile. To increase durability and/or water resistance, non-textile components may be added and secured (e.g., adhered, stitched) to the textile. For example, polyurethanes (e.g., crosslinked polyurethanes), synthetic leather textiles, or laminate film layers can be used as durable covering layers. However, the addition of any additional layer, even a film, reduces the ability of the article to conform to a wearer and provide proprioceptive feedback, which can be particularly important for articles in certain sporting activities. In an article of footwear for football, for example, it may be important for a wearer to be able to feel the ball through the textile as well as to have certain levels of traction or grip for ball control and handling. At the same time, too much grip in the footwear may interfere with the wearer's ability to perform quick touches and ball handling maneuvers. Further, as different parts of the footwear may be utilized for different types of moves, a textile for an upper with different characteristics (e.g., patterns) in different portions may be desired.

As will be discussed in detail hereinafter, grip or traction for object (e.g., ball) control is achieved with alternating patterns of first areas and second areas having varying grip. These alternating patterns assist in fine tuning ball control such that a desirable amount of grip is achieved. For example, the textiles described herein, such as knitted components or footwear uppers, can include alternating patterns of first areas with a first coefficient of friction and second areas with a second coefficient of friction that is different from or lower than the first coefficient of friction. This alternating between a first area and the second area on a surface of a footwear upper achieves an interaction between the footwear upper and the object, such as a ball, that may enhance a sense of control by the wearer of the footwear upper. Further, it is contemplated that a surface of a footwear upper having alternating patterns of the first areas and the second areas in which the first areas are 40% to 80% of a total surface area of an external-facing surface of a portion (e.g., a ball-contacting region) of the footwear upper is effective to achieve a potentially enhanced sense of control by the wearer of the footwear upper.

Thermoplastic elastomers have been identified which can be incorporated into polymeric compositions that provide levels of abrasion resistance, traction (which may also be referred to as grip), or both, making them suitable for use in articles where abrasion resistance or traction are desirable, such as articles of apparel, footwear and sporting equipment. In many cases, the level of abrasion resistance, traction, or both provided by these polymeric compositions are equivalent to or better than standard vulcanized rubber compositions used in the manufacture of footwear, apparel and sporting equipment. Unlike vulcanized rubber, due to the thermoplastic nature of these polymeric compositions, and their properties in the solid and molten state, it is possible to readily form them into coated yarns that have suitable properties for use in industrial scale knitting or weaving equipment. These properties result in yarns that can readily be incorporated into various articles including textiles using conventional manufacturing processes such as knitting and weaving, as well as industrial scale processes for making non-woven textiles. Also, unlike vulcanized rubber, these textiles and articles into which these textiles are incorporated can then, in turn, be thermoformed in a manner that reflows the polymeric composition of the coated yarns and creates an abrasion resistant or high grip surface on the textile or article under conditions that do not damage other components of the textile or article, such as, for example, other yarns, other textiles, foams, molded resin components, etc.

At a high level, various aspects of this disclosure are directed to incorporating these thermoplastic elastomers into textiles in articles to maximize certain desired functionality, such as ball control and durability. Specifically, a knitted component may include a first yarn having a first core yarn (also referred to herein as a "core") and a first coating (also referred to herein as a "coating") comprising a thermoplastic elastomer. The thermoplastic composition comprises one or more thermoplastic elastomers at least partially surrounding the first core yarn. The knitted component further includes a second yarn that is different from the first yarn. On a first surface of the knitted component (e.g., an externally-facing surface of an article formed with the knitted component), first areas are formed of the first yarn while second areas are formed of the second yarn. Due at least in part to the material of the first yarn and the second yarn, the first areas and the second areas have different coefficients of friction relative to a common material. Specifically, the first areas may have a higher coefficient of friction than the second areas to provide increased grip in the first areas relative to the second areas. For example, the first areas may have a higher coefficient of friction with a ball surface than a coefficient of friction between the second area and the same ball surface. Furthermore, the first and second areas may form an alternating pattern where the first areas make up 40% to 80% of the total surface area of the first surface (e.g., a ball-contacting portion of a footwear upper), which may provide an improved level of grip over the knitted component.

When the knitted component is integrated into an upper for an article of footwear, such as a football shoe, the alternating pattern of the first and second areas may improve ball control and handling as well as provide abrasion resistance. In some aspects, the alternating pattern includes a pattern of concentric shapes (e.g., curvilinear boundaries between first areas and second areas) on a medial side of the upper. In some aspects, first and second areas may form a different alternating pattern of stripes (e.g., linear boundaries between first areas and second areas). The stripes, in an example, generally extend from a biteline to a throat, such as on a lateral side of the upper. Whereas the concentric shape patterns of the first and second areas on the medial side may be desired for ball passing, receiving, and kicking movements, a more linear pattern on the lateral side may be desired for dragging movements or nudging of the ball.

Furthermore, in some aspects, the knitted component may be thermoformed such that the first coating flows and occupies at least a portion of spaces between courses of the first yarn or courses of the first core yarn. This arrangement can advantageously integrate 360-degree ball control directly into the knitted component without the need for laminated skins, streamlining the surface into a single functional layer. When the textile is used for an upper of a shoe or a football boot, this single functional layer can help bring the wearer closer to the ball by removing a layer therefrom, which thereby increases proprioceptive feedback to the wearer and further improves ball control. Additionally, not including a laminated skin improves manufacturing efficiency by reducing post-knitting processes.

Aspects of this disclosure may further include methods of manufacturing a knitted component. The method may include knitting a knitted component with a first yarn integrally knit with a second yarn. As described above, the first yarn may include a first core yarn and a first coating at least partially surrounding the first core yarn and comprising a polymeric composition comprising one or more thermoplastic elastomers, the coating at least partially surrounding the first core yarn. Further, within the knitting component, the first yarn forms first areas on a first surface of the knitted component and the second yarn forms second areas on the first surface of the knitted component, where the first areas have a different coefficient of friction than the second areas. Further, the first areas may form an alternating pattern with the second areas as described above.

Aspects further include methods of manufacturing a knitted component for an upper. A knitted component having the first yarn integrally knit with the second yarn as described above may be thermoformed such that the first coating may be re-flowed and re-solidified to create a thermoformed network of interlooped yarns. The thermoformed network comprises the first core yarn and the first coating surrounding at least a portion of the first core yarn and occupying spaces between at least some portions of the yarn in the thermoformed network. The method may further include molding the first surface to create raised portions of the thermoformed network, where the raised portions may form a concentric pattern within the knitted component. Further aspects of the disclosure may include methods of manufacturing an article of footwear by attaching an upper comprising the thermoformed knitted component to a sole structure.

As discussed above, certain aspects are directed to one or more knitted components or thermoformed knitted components. In certain aspects, such knitted components or thermoformed knitted components form at least a portion of an article of sporting equipment or article of wear, including articles of footwear. In an illustrative example, aspects are directed to an upper for an article of footwear formed of a knitted component. Articles of footwear conventionally include an upper and a sole structure. The upper is secured to the sole structure and forms a void within the article of footwear for comfortably and securely receiving a foot. As used herein, the term "upper" refers to a footwear component that extends over the instep and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Further, in other aspects, the upper may also be incorporated into a non-athletic shoe, such as a dress shoe, a loafer, and a sandal. Accordingly, the concepts disclosed with respect to articles of footwear apply to a wide variety of footwear types.

Positional terms used when describing the upper, such as top, bottom, front, sides, back, superior, inferior, lateral, medial, right, left, inner-facing, external-facing, and the like, are used with respect to the upper being worn as intended with the wearer standing upright such that the wearer's foot is in the foot-receiving void and the wearer's ankle or leg extends through the ankle opening. It should be understood, however, that use of positional terms do not depend on the actual presence of a human being for interpretative purposes.

The term "knitted component" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as-knit) that are produced by adjacent needles during the same knitting cycle. The course may comprise one or more stitch types, such as a knit stitch, a held stitch, a float stitch, a tuck stitch, a transfer stitch, a rib stitch, and the like as these terms are known in the art of knitting. The term "knit stitch," as used herein, refers to the basic stitch type where the yarn is cleared from the needle after pulling a loop of the yarn from the back to the front of the textile through a previous stitch. The term "wale," as used herein, is a predominantly vertical column of intermeshed or interlooped knit loops, generally produced by the same needle at successive (but not necessarily all) courses or knitting cycles. Knitted components described herein may include weft-knitted or warp-knitted components.

The term "integrally knit," as used herein, may mean a knit textile having a yarn from one or more knitted courses in one area being interlooped with one or more knitted courses of another area. The interlooping may be through a simple knit stitch, a tuck stitch, a held stitch, a float or miss stitch, and the like. In this way, areas that are integrally knit together have a seamless transition.

As used herein, the term "double knit construction" refers to a textile or textile portion knit on a machine with two sets of needles in two needle beds or cylinders. Some aspects herein contemplate the machine comprising a weft knit (flat knit) machine. The term "bed" is typically used when describing flat knit machines. However, it should be understood that aspects herein may relate to warp-knitted components as well. To describe in a different way, the term double knit construction means a textile having front courses formed on a first needle bed and back courses formed on a second needle bed. The front courses of a double knit constructed textile are courses of interlooped stitches forming a front layer of the textile, and the back courses are courses of interlooped stitches forming a back layer of the textile such that the front layer and the back layer of the textile may be formed at substantially the same time. As used herein, the term "front layer" refers to a textile layer that is configured to face externally when the article incorporating the textile, such as the upper, is worn, and the term "back layer" refers to a textile layer that is configured to be facing a skin surface of the wearer when the article is worn.

Additionally, there are various measurements provided herein. Unless indicated otherwise, the term "about" or "substantially" with respect to a measurement means within ±10% of the indicated value.

Figure 1B:
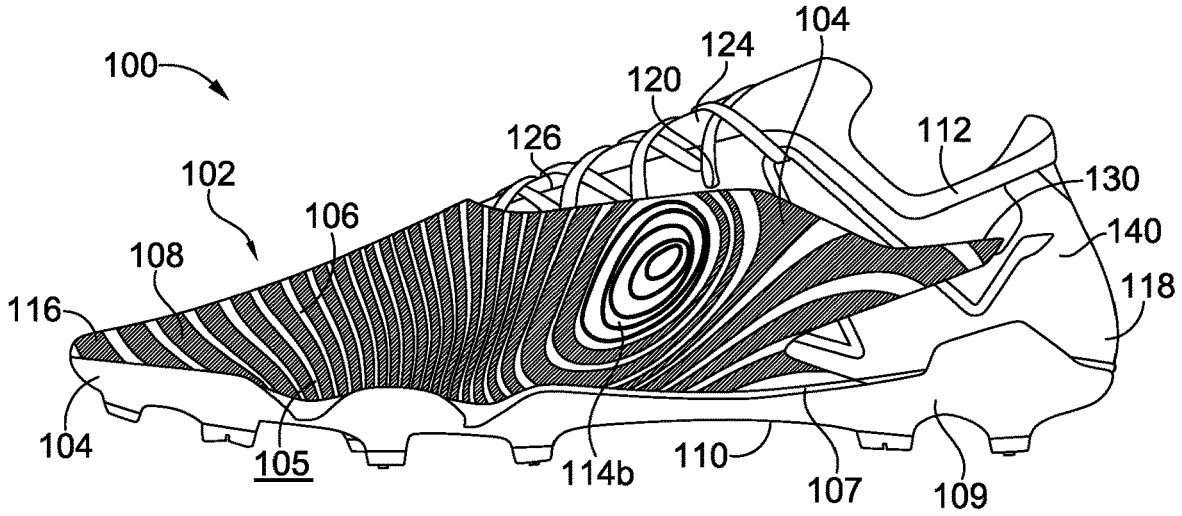
FIG. 1B is a medial side perspective view of the article of footwear of FIG. 1A, in accordance with aspects herein.

Turning now to the figures, in particular, FIGS. 1A and 1B, an article of footwear 100 is depicted as one exemplary article of wear. While FIGS. 1A and 1B depict the article of footwear 100, it should be understood that other articles of wear are also contemplated by the present disclosure, including but not limited to apparel (e.g., shirts, jerseys, pants, shorts, gloves, glasses, socks, hats, caps, jackets, undergarments) and containers (e.g., backpacks, bags). The article of footwear 100 of FIGS. 1A and 1B generally may include a ground-facing outsole area 110, an ankle collar area 112, a lateral midfoot area 114*a*, a medial midfoot area 114*b*, a forefoot area 116, and a heel area 118. Further, the article of footwear 100 may include a plurality of eyestays 120, a tongue 124, and a throat area 126. As shown in FIGS. 1A and 1B, the article of footwear 100, is intended to be used with a right foot; however, it should be understood that the following discussion may also apply to a mirror image of the article of footwear 100 that is intended for use with a left foot.

In some aspects, the article of footwear 100 includes a sole structure 104 and an upper 102. The sole structure 104 is secured to the upper 102 and extends between the foot and the ground when the article of footwear 100 is worn. In some aspects, the sole structure 104 includes a midsole 107 and an outsole 109. The midsole 107 may be secured to a lower area of the upper 102 such as a strobel (not shown) and may include a cushioning element comprising a resilient material such as a polymer foam or another appropriate material. In other configurations, the cushioning element of the midsole 107 may incorporate fluid-filled chambers, plates, moderators, and/or other elements that further attenuate forces, enhance stability, or influence motions of the foot. The outsole 109 may be secured to a lower surface of the midsole 107 and may comprise a wear-resistant elastomeric material such as a natural or synthetic rubber material. The outsole 109 may be textured to impart traction or can include one or more traction elements. The traction elements may be separate elements affixed to the outsole 109 or may be integrally formed with the outsole 109.

The upper 102 may be formed from various elements (e.g., lace stays, tongue collar, medial side, lateral side, vamp, toe box, heel counter) that combine to provide a structure for securely and comfortably receiving a foot. Although the configuration of the upper 102 may vary significantly, the various elements generally define a void within the upper 102 for receiving and securing the foot relative to sole structure 104. Surfaces of the void within upper 102 are shaped to accommodate the foot and may extend over the instep and toe areas of the foot, along the medial and lateral sides of the foot, under the foot, and around the heel area of the foot.

At least a portion of the upper 102 may be formed of at least one knitted component 130, such as by a weft-knitting process or a warp-knitting process on a flat knitting machine, for example. The knitted component 130 may be formed as a single integral one-piece element during a knitting process, such as weft knitting, warp knitting, or any other suitable knitting process. In the example depicted in FIGS. 1A and 1B, the knitted component 130 forms an outer sheath of the upper 102, forming at least an exterior surface of the lateral midfoot area 114*a*, the medial midfoot area 114*b*, the forefoot area 116, and at least part of the throat area 126 of the upper 102. In some aspects, the knitted component 130 further forms an interior surface of the upper 102.

The upper 102 may also include one or more additional components, such as a textile component 140, which may be knit, woven, non-woven, or another type of textile. The textile component 140 may form the at least part of the heel area 118, the ankle collar area 112, and the tongue 124. The textile component 140 may be a single textile component or may be formed of multiple textile components secured together. Further, in aspects, the textile component 140 may be integrally knitted with the knitted component 130. Alternatively, the textile component 140 may be secured to the knitted component 130 via at least one of stitching, bonding, and the like.

The knitted component 130 may include one or more different types of yarns for imparting different functionality. For example, the knitted component 130 may include a first yarn and a second yarn. The first yarn (also referred to as first coated yarn or coated yarns herein) includes a first core yarn and a first coating providing a first set of properties to the first yarn. The second yarn may have a different material composition than the first yarn. For example, the second yarn may at least include a different coating than the first coating of the first yarn such that the second yarn exhibits different properties than the first yarn.

Further, within the first yarn, the first core yarn and the first coating may have different material compositions to provide different properties. For example, as described herein, the first coating may comprise a low processing temperature polymeric composition while the first core yarn may comprise a high processing temperature polymer composition such that the first coating may melt or deform at a temperature that leaves the core yarn intact. In one aspect, the deformation temperature of the polymeric composition of the core yarn of the first yarn is at least 20 degrees Celsius higher than the melting temperature of the polymeric composition, such as a polymeric composition comprising a thermoplastic composition, of the first coating. This allows the core yarn to be coated by the coating when the coating is in a molten state.

The first core yarn of the first yarn may comprise a monofilament or multifilament yarn, such as a commercially available polyester or polyamide yarn having properties (such as denier and tenacity) sufficient for the yarn to be manipulated by industrial-scale knitting equipment. Further, the core yarn may be based on natural or manmade fibers including polyester, high tenacity polyester, polyamide yarns, metal yarns, stretch yarns, carbon yarns, glass yarns, polyethylene or polyolefin yarns, bi-component yarns, PTFE yarns, ultra-high-molecular-weight polyethylene (UHMWPE) yarns, liquid crystal polymer yarns, specialty decorative yarns or reflective yarns or a multi-component yarn comprising one or more of the yarns. In example aspects, the core yarn comprises a thermoplastic material comprising a polyester.

In various aspects, the first core yarn may be coated by any method known in the art. In one aspect, the polymeric compositions for the first coating disclosed herein are suitable for manufacturing by pultrusion and/or pulling the yarns through baths of liquid polymeric materials. In still another aspect, regardless of coating process, sufficient coating material is provided on the first yarn such that, when knit alone or with one or more other yarns in various configurations and subsequently thermoformed and allowed to re-flow and re-solidify, the coating material (e.g., polymeric composition comprising a thermoplastic elastomer) forms a structure with an adequate concentration of the coating material on one or more surfaces, and/or within the first core yarn, depending upon the placement of the first yarn within the knit structure.

The first coating of the first yarn comprises a polymeric composition that comprises a thermoplastic composition that comprises a thermoplastic elastomer. While it is possible to extrude a polymeric composition that is a thermoplastic elastomeric composition and form fibers, filaments, yarns or films directly from the polymeric composition, due to its elastomeric properties, these forms of the polymeric composition will have high levels of stretch and heat shrinkage. This means the fibers, filaments, yarns or films may tend to stretch around machine guides, rather than slide past them, and may tend to shrink at the temperatures commonly encountered in industrial-scale knitting and weaving equipment. However, by applying the polymeric composition as a coating onto a core yarn that is suitable to be mechanically manipulated, the resulting coated first yarn retains the tenacity and stretch resistance of the core yarn, while also providing an external-facing surface having superior traction and abrasion resistance provided by the polymeric composition of the coating due to its elastomeric properties. For example, it has been found that a 150-denier core yarn having a tensile strength of at least 1 kilogram-force at break and less than 20 percent strain to break and a heat shrink of less than 20 percent may be coated with the polymeric composition to a nominal average outer diameter of up to about 1.0 millimeter and still retain its ability to be knit or inlaid using commercial flat-knitting equipment. Due to the ability to use this yarn on industrial-scale equipment, this first yarn may also allow for new methods of manufacturing that will allow for different placements of the polymeric composition within textiles and articles comprising the textiles at greater levels of specificity in terms of both location and amount as compared to conventional manufacturing processes.

Additionally, the thermoplastic nature of the polymeric composition makes it possible to melt the composition and use it to coat the first core yarn when the melting temperature of the polymeric composition is sufficiently lower than the deformation temperature of the first core yarn, as well as to subsequently thermoform the knitted component 130 to create a thermoformed network comprising both the first core yarn and the re-flowed and re-solidified polymeric composition consolidating the first core yarn. In one aspect, the thermoplastic elastomer(s) of the polymeric composition of the coating have glass transition temperature(s) below minus 20 degrees Celsius, which allows the thermoplastic elastomer(s) present in the polymeric composition to be in their "rubbery" state, even when the knitted component 130 is used in cold environments. In another aspect, the melting temperature of polymeric composition of the coating is at least 100 degrees Celsius, which may ensure the polymeric composition will not melt when the knitted component 130 is shipped or stored under hot conditions. In another aspect, the melting temperature of polymeric composition of the coating is at least 130 degrees Celsius, which ensures the polymeric composition will not melt when the knitted component 130 is subjected to conditions often encountered by textiles during the manufacturing processes for articles of footwear, apparel or sporting equipment, such as steaming processes. In another aspect, the melting temperature of polymeric composition of the coating is at less than 170 degrees Celsius, which ensures the knitted component 130 may be thermoformed at temperatures that do not negatively impact other textiles or components that may form part of the upper 102. In another aspect, the enthalpy of melting of the thermoplastic elastomer(s) of the polymeric composition of the coating may be less than about 30 Joules per gram or 25 Joules per gram, which means that, during the thermoforming process, less heat and a shorter heating time is required to fully melt the polymeric composition and achieve good flow of the molten polymeric composition to better consolidate the network of yarns in the knitted component 130. In another aspect, the recrystallization temperature of thermoplastic elastomer(s) of the polymeric composition of the coating may be above 60 degrees Celsius, or above 95 degrees Celsius, which may promote rapid resolidification of the polymeric composition after thermoforming, which may reduce the amount of time required to cool the textile after thermoforming and may avoid the need to provide active cooling of the textile, thereby reducing cycle time and reducing energy consumption.

Because the knitted component 130 also includes the second yarn in addition to the first yarn (i.e., the coated yarn), the thermoformed network of yarns (i.e., the core yarn from the first yarn and the second yarn) are consolidated by the re-flowed and re-solidified polymeric composition. The presence of the re-flowed and re-solidified polymeric composition may serve one or more functions within the thermoformed textile, such as controlling the level of stretch within the entire knitted component 130 or just within a region thereof, forming a skin having high abrasion-resistance and/or traction across an entire surface of the knitted component 130 or just within a region thereof, improving water resistance of an entire surface of the knitted component 130 or just within a region thereof, or bonding all of the knitted component 130 or just a region thereof to a substrate.

Use of the first yarn in the knitted component 130 may also reduce the number of different materials required to form an article. The coating of the first yarn, when thermoformed, may form a skin on a surface of the knitted component 130. Alternatively or additionally, the coating of the first yarn, when thermoformed, may act as a bonding agent, either to bond yarns together within the knitted component 130, or to bond other elements to a surface of the knitted component 130. The use of the thermoformed knitted component 130 described herein may replace one or more of the separate elements conventionally added to increase abrasion resistance or create traction, reducing waste and simplifying manufacturing processes while improving recyclability of the articles. Additionally, creating these properties within the knit structure of the knitted component 130, rather than as an additional layer, helps the knitted component 130 form the shape of the wearer's foot and enable more proprioceptive feedback, such as when handling a football. Note that other balls may be used with the articles of footwear described herein without departing from the scope of the technology herein.

This thermoformed network of the thermoformed textile may form an externally-facing surface of an upper, such as the first surface 105 of the knitted component 130 in FIGS. 1A and 1B. Unexpectedly, the thermoformed network created by thermoforming the textiles has superior properties for ball contact, in that the properties of the thermoformed network may be equal to or superior to those of kangaroo skin leather in terms of the spin rate imparted to the ball by the upper when kicking the ball. For example, it has been found that using polymeric compositions having a Durometer Hardness (Shore A) of about 65 to about 85 results in uppers with improved ball spin rates. Uppers comprising the textiles described herein have also been found to be equivalent to or superior to those of synthetic leather or knit uppers coated with a skin in terms of traction under wet and dry conditions.

As described herein, the second yarn may be integrally knit with the first yarn to form the thermoformed network in at least some regions of the knitted component 130. Specifically, the knitted component 130 may have a first surface 105 forming an exterior-facing surface of the upper 102 as shown in FIGS. 1A and 1B. The knitted component 130 may also include an opposite second surface, which may form the inner-facing surface of the upper 102 and is not visible in FIGS. 1A and 1B. The first surface 105 may include a plurality of first areas and a plurality of second areas (e.g., first areas 108 and second areas 106). To distinguish between these areas in FIGS. 1A and 1B, first areas 104 are depicted with a lighter shading than the second area 106. However, it should be understood that the shading should not necessarily limit the relative coloring of these areas 104 and 106.

The first areas 108 on the first surface 105 comprise the first yarn and the second areas 106 on the first surface 105 comprise the second yarn. In various aspects, the second areas 106 entirely or substantially exclude the first yarn. In some aspects, the first areas 108 entirely or substantially exclude the second yarn. In other aspects, the first areas 108 may have trace amounts of the first yarn and/or the second areas 106 may have trace amounts of the second yarn without departing from the technology described herein. "Trace amounts" is defined herein as approximately less than 10% by weight of a particular yarn (for example, less than 10% by weight of the first yarn or less than 10% by weight of the second yarn).

As described above, the first yarn may have a first core yarn and a first coating comprising a thermoplastic polymeric composition. The thermoplastic polymeric composition may comprise one or more thermoplastic elastomers at least partially surrounding the first core yarn. The second yarn may include filaments of a thermoplastic material comprising a polyester. However, the second yarn does not include the thermoplastic polymeric composition that makes up the first coating, in an example.

As previously described, the first yarn and the second yarn may have different physical properties. For example, the first coating of the first yarn has a first deformation temperature and the second yarn has a second deformation temperature that is greater than the first deformation temperature. In certain aspects, this second deformation temperature is the lower of either a second melting temperature or a second decomposition temperature. As such, the first yarn, or at least the coating of the first yarn, may melt, flow, or become molten to create the thermoformed network described herein while the structure of the second yarn remains intact. In various aspects, the deformation temperature of the coating is at least 20 degrees Celsius lower than the second deformation temperature of the second yarn. For example, in various aspects, the melting temperature of the coating of the first yarn is at least 100 degrees Celsius, at least 130 degrees Celsius, or at least 170 degrees Celsius, and in each instance, the second deformation temperature may be at least 20 degrees Celsius greater than the melting temperature of the coating of the first yarn.

At least partly due to the selective use of the first yarn and the second yarn, first areas 108 have a different coefficient of friction than the second areas 106. When relative coefficients of friction are mentioned herein, a common testing standard is applied to both the first areas and the second areas. For example, a sample with just the first areas can be tested using ASTM D1894 to determine the static or dynamic coefficient of friction of the first areas described herein. Likewise, a sample with just the second areas can be tested using ASTM D1894 to determine the static or dynamic coefficient of friction of the second areas described herein. However, as described below, modified versions of the ASTM D1894 or other tests can be used without departing from the scope of the technology herein, as long as a common testing standard is applied for both the first areas and the second areas. Stated differently, when a first area has a higher coefficient of friction as compared to a second area, both of an exclusive first area sample and an exclusive second area sample are measured using the same test (e.g., same testing standard and/or process) and the same conditions (e.g., wet, dry, temperature) such that the only variable, in this example, is a change of the material (e.g., the first area and the second area) for which a coefficient of friction is determined. Therefore, a relative coefficient of friction (e.g., the first area has a higher coefficient of friction than the second area) may be determined between the first area and the second area.

In some aspects, the first areas 108 have a higher coefficient of friction than the second areas 106. Coefficient of friction may be based on either wet or dry conditions. In various aspects, the first areas 108 have a higher coefficient of friction than the second areas in both wet and dry conditions. In one aspect, the dry dynamic coefficient of friction of the first areas 108, as tested on a dry sample of football material, is from about 0.90 to about 1.50. Additionally, the wet dynamic coefficient of friction of the first areas 108, as tested on a wet sample of football material, may be from about 0.50 to about 0.80. Further, in some aspects, the difference between the dynamic coefficient of friction of the first areas 108 on the dry sample of football material versus the wet sample of football material is less than 40 percent. In this way, the first yarn forming the first areas 108 may enable the first areas 108 to have traction or grip on objects, such as a football, in both dry and wet conditions. In this way, the first yarn may enable a wearer to have good ball control in various weather conditions and may reduce slippage of the football when wet. All coefficient of friction values disclosed herein may be obtained using the Textile-Ball Coefficient of Friction Test described below.

While grip (which may be represented by a coefficient of friction) is helpful for ball control, too much grip decreases the speed at which a wearer manipulates the ball. In some activities, such as football, there are times when soft, quick touches are desired and, therefore, having areas that counterbalance the coefficient of friction from the first areas 108 may help to provide the optimal level of overall grip and ball control. As such, the second areas 106 that do not include the first yarn have a lower coefficient of friction than the first yarn in wet and dry conditions. For example, the coefficient of friction (wet or dry) for the second areas 106 may be within a range from about 10% to about 75% less than the coefficient of friction (wet or dry) of the first areas 108, within a range from about 15% to about 60% less than the coefficient of friction (wet or dry) for the first areas 108, or within a range from about 20% to about 50% less than the coefficient of friction (wet or dry) for the first areas 108.

The first and second areas 108 and 106 may also have other differing physical properties. For example, the first yarn or the first coating of the first yarn and the second yarn may differ based on at least one of a hue, a value, and chroma of their colors. As such, the first areas 108 and the second areas 106 may differ based on at least one of a hue, a value, and a chroma of their colors. Other visual differences between the first yarn and the second yarn and the first areas 108 and the second areas 106 may be used without departing from the scope of the technology herein. However, in some aspects, visual differences between the first and second areas 108 and 106 may be minimal or nonexistent, while differences in other physical characteristics remain.

As shown in FIGS. 1A and 1B, the first areas 108 and the second areas 106 form an alternating pattern on a surface of the upper 102. For example, one of the first areas 108 may be positioned between two of the second areas 106 or, in other words, one of the second areas 106 may be positioned between two of the first areas 108. Alternating the first areas 108 and the second areas 106 in this way may provide optimal grip within regions of the upper 102 for improved ball control. In various aspects, the size and dimensions of each of the first areas 108 and second areas 106 may vary depending upon the amount of grip and/or ball control desired. For example, the size and dimensions of the first areas 108 may be similar or different from the size and dimensions of the second areas 106, however, the ratio of the total surface area of the first areas 108 to the second areas 106 depends upon the amount of grip and/or ball control desired. For example, the ratio of the total surface area of the first areas 108 to the second areas 106 may be greater in instances where more grip and/or ball control is desired, whereas the ratio of the total surface area of the first areas 108 to the second areas 106 may be less in instances where less grip is desired. In some aspects, the first areas 108 make up a percentage of the total surface area within a region of the first surface 105 of the knitted component 103 that is within a range from about 40% to about 80%, within a range from about 50% to about 70%, and/or within a range from about 55% to about 65%. The ranges provided herein are inclusive of the values on either end of the range. For example, the range of 40% to 80% is inclusive of 40% and 80%. As such, the second areas 106 may form a percentage of the total surface area of the first surface 105 of the knitted component 103 that is within a range from about 20% to about 60%, within a range from about 30% to about 50%, and/or within a range from about 55% to about 65%.

The lateral side of the upper 102 depicted in FIG. 1A includes the first areas 108 and the second areas 106 arranged in an alternating striped pattern extending generally vertically when the upper 102 is in an as-worn configuration with the sole structure 104 contacting a ground surface. As such, the first areas 108 and the second areas 106 may generally extend from a bottom edge 150 of the knitted component 130 towards the throat area 126. At least part of the bottom edge 150 of the knitted component 130 may align with the biteline 152 where the upper 102 joins the sole structure 104. The stripes formed by alternating the first areas 108 and the second areas 106 on the lateral side may extend in the lateral midfoot area 114*a* as well as in the forefoot area 116. Further, in aspects in which the knitted component 130 extends to the heel area 118, the stripes may also extend in the heel area 118. A stripe is an example of an alternating pattern that includes linear boundaries between first areas 108 and second areas 106.

At least some of the stripes may have a zig-zag configuration, a wavy-line configuration, a parallel line configuration, and/or any other striped configuration, such as stripes that follow a curvature of the knitted component 130. Additionally or alternatively, at least portions of the stripes may have varying widths along a length thereof. For example, the varying widths may range from as narrow as 3 millimeters to as wide as one centimeter. Any number of stripes formed via the alternating of the first areas 108 and the second areas 106 may be included on the knitted component 130. In some aspects, the first areas 108 form between 10 and 40 stripes on the first surface 105 of the knitted component 130, while in other aspects, the first areas 108 form between 25 and 35 stripes on first surface 105 of the knitted component 130. However, the number and configuration of the stripes depends upon the amount of grip and/or ball control desired and, in turn, the ratio of total surface area of the first areas 108 to the second areas 106 as discussed above.

On the medial side of the upper 102 depicted in FIG. 1B, the first areas 108 and the second areas 106 alternate to form a concentric pattern of shapes or, in other words, a "swirl" or "whirl" pattern. In this example, the concentric pattern of the first areas 108 and the second areas 106 includes irregularly-shaped circles. Swirl or whirl patterns are examples of alternating patterns having curvilinear boundaries between the first areas 108 and the second areas 106. Additionally or alternatively, the concentric shapes may be triangular, circular, ovular, parallelograms, pentagons, hexagons, star-shaped, heart-shaped, a combination thereof, or any combination of concentric shapes without departing from the scope of the technology described herein. The pattern is concentric in that at least the first areas 108 and the second areas 108 that are part of the concentric pattern are coaxial and share a common center. The center of the concentric pattern in FIG. 1B is positioned within the medial midfoot area 114*b* and helps to impart spin on a ball, such as a football, when kicked. Within the region of the concentric pattern closer to the center in the medial midfoot area 114*b*, the second areas 106 may cover more of the first surface 105 than is covered by the first areas 108 in this region of the upper.

In some aspects, the concentric pattern within the medial midfoot area 114*b* may be nestled between a series of stripes formed by alternating additional first areas 108 and additional second areas 106. One or more of these stripes adjacent to the concentric pattern may have a curvature or angle that corresponds to a curvature or angle of the shapes forming the concentric pattern, as shown in FIG. 1B.

Figure 1C:
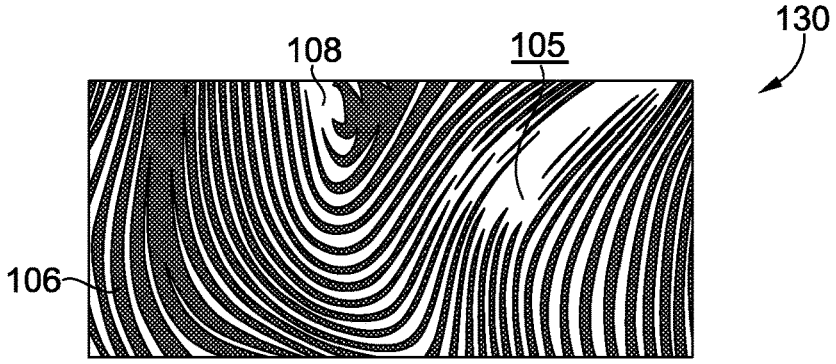
FIG. 1C is a medial side perspective view of the article of footwear of FIG. 1A with an alternative pattern, in accordance with aspects herein.

FIG. 1C depicts another aspect of the alternating pattern of the first areas 108 and the second areas 106 on a medial side of the upper 102. In this configuration, the first areas 108 and the second areas 106 may still generally form a concentric pattern of shapes, but the shapes may be formed of broken lines of varying length and curvature that cooperatively form the shape within the concentric pattern.

The use of the different types of alternating patterns of first areas 108 and second areas 106 on the lateral and medial sides of the upper 102 reflects different types of movement that may be executed in certain activities. For example, in football, the medial side of the foot is often used for passing, receiving, and/or kicking a ball while the lateral side of the foot is used for other ball manipulation, such as dragging or nudging of the ball. As such, different ratios and patterns of the first areas 108 and the second areas 106 may provide different grip patterns suited for particular activities. For instance, the concentric pattern in the medial midfoot area 114*b* provides a more omnidirectional variance in the coefficients of friction between the first areas 108 and the second areas 106, which may enable better ball control for receiving, passing, and/or kicking movements. As discussed above, the concentric pattern may also enable the wearer to impart more or less spin on the ball when kicked. In contrast, the striped pattern on the lateral side provides a variance in the coefficients of friction of the first areas 108 and the second areas 107 in a more longitudinal direction (i.e., a direction extending from the forefoot area 116 to the heel area 118) that may enable better control of the ball while dragging or nudging.

Although the aspects described herein feature the concentric patterns and striped patterns located on the upper of the article of footwear, note that such patterns may additionally or alternatively be placed on a sole or bottom of an article of footwear to reflect different types of movement that may be executed in certain activities. Specifically, the patterns may be customized to include different variance in coefficients of friction of the first areas and the second areas on a front or toe area of the outsole 109 than on a back or heel area of the outsole 109.

As described above, some aspects of the knitted component 130 is a double knit structure formed on two knitting beds. The first yarn and the second yarn may both be used to form knit loops on a front bed and loops on a back bed within a course and/or along a wale such that the first yarn and the second yarn may alternate forming the first surface 105 of the knitted component 105. For example, the first yarn may form loops on needles of a front bed to form the first areas 108, while the second yarn is floated or forming loops on needles of a back bed,—whereas the second areas 106 may be formed when the second yarn forms loops on needles on the front bed while the first yarn is floated or forms loops on needles on the back bed.

In some aspects, the knitted component 130 includes a third yarn comprising an elastane or an elastic polyurethane material. In exemplary aspects, the third yarn is knit on the second surface of the knitted component 130 opposite the first surface 105. Specifically, the third yarn may be knit on the second surface in areas opposite the first areas 108 and second areas 106 on the first surface 105. In some aspects, the third yarn is knit only on one needle bed, such as a back needle bed, such that the third yarn is only on the second surface and is absent from the first surface 105. Including the third yarn with an elastane or an elastic polyurethane material on the second surface (e.g., inner-facing surface) of the knitted component 130 provides some resilience to the knitted component 130, which enhances the proprioceptive feedback to a wearer when the knitted component 130 on the upper 102 is in contact with an object, such as a ball.

As discussed above, the first yarn has a coating that, through thermoforming, may melt or deform and subsequently solidify to form a thermoformed network with the core yarn of the first yarn and portions of one or more other yarns, such as the second yarn, and, in some aspects, the third yarn. In this way, the thermoforming process may transform at least a portion of the knit structure of the knitted component 130. For example, after knitting, the knitted component 130 may comprise interconnected courses of loops of the first yarn and the second yarn, and after thermoforming, the knitted component 130 may not include interconnected courses of loops of the first yarn and the second yarn in thermoformed portions at least partly due to the deformation or melting of the coating of the first yarn. At the same time, the core yarn of the first yarn may still form interconnected loops with the second yarn, and the remaining loops may still be connected via the melted and resolidified coating material.

Figure 2A:
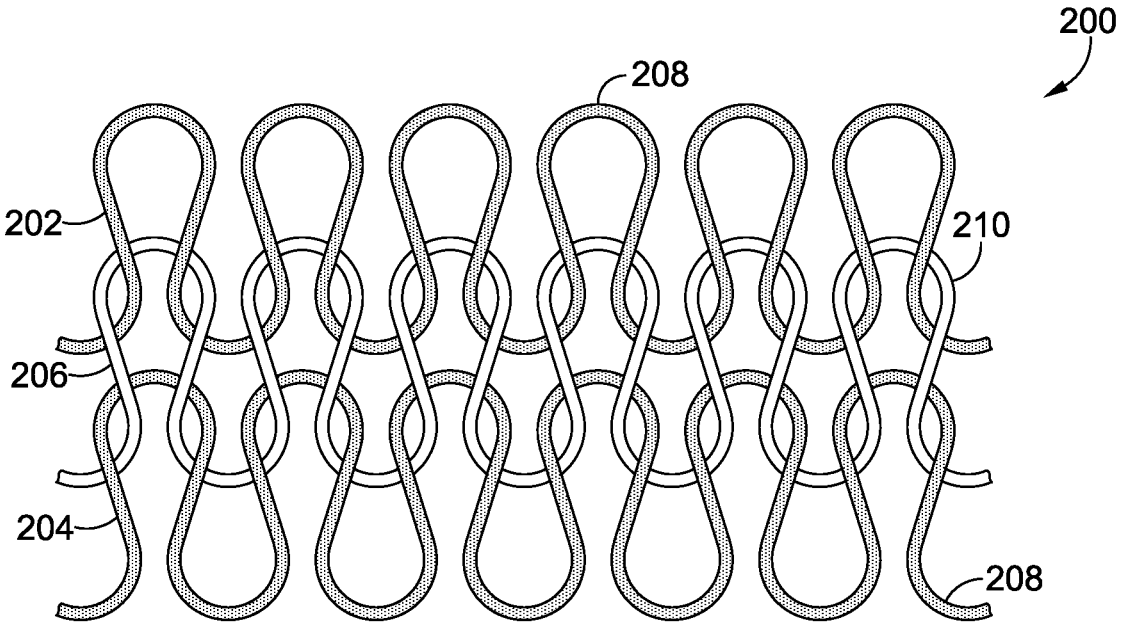
FIG. 2A is a schematic representation of three interconnected courses of loops with the middle course being formed of a first yarn and the outer courses of loops being formed of a second yarn, in accordance with aspects herein.

FIG. 2A schematically depicts a portion 200 of an example knitted component, which may be the knitted component 130 of FIGS. 1A-C, prior to a thermoforming process. The portion 200 includes interconnected courses of a first yarn 210, which may be the first coated yarn described herein, and a second yarn 208, which may be the second yarn described with respect to FIGS. 1A-C. The portion 200 includes a first course 202 and a second course 204 having the second yarn 208, and a third course 206 of the first yarn 210. In such an aspect, the third course 206 of loops of the first yarn 210 may be interconnected (e.g., interlooped) to the first course 202 and the second course 204 having the second yarn 208.

Figure 2B:
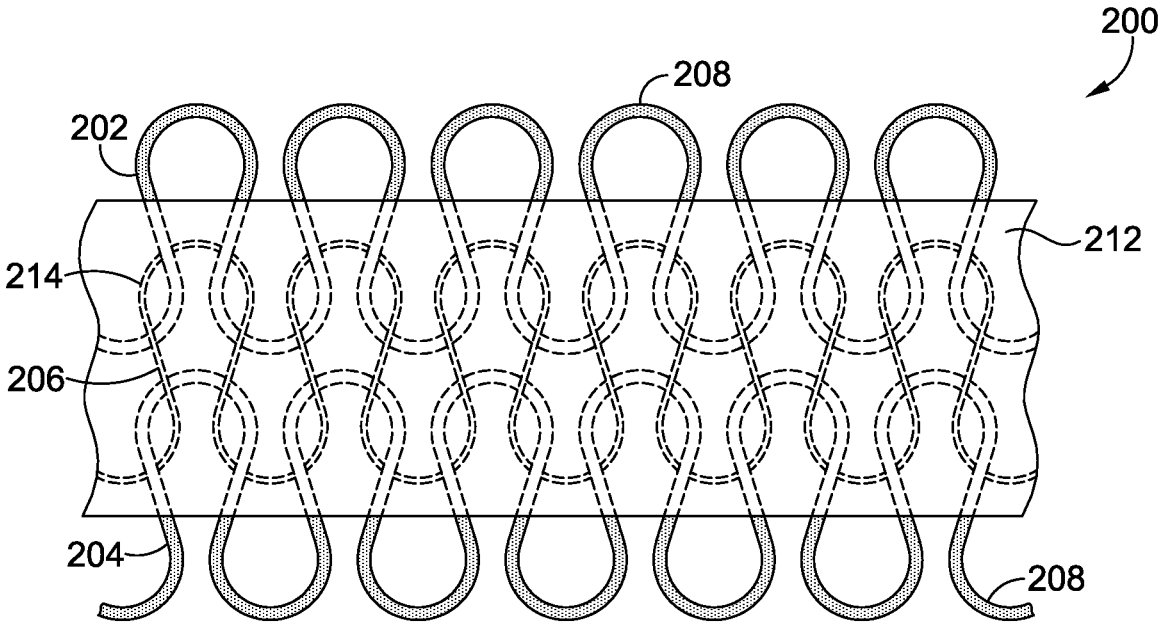
FIG. 2B is a schematic representation of the interconnected courses of loops of FIG. 2A after being exposed to a thermoforming process, in accordance with aspects herein.

FIG. 2B depicts the portion 200 after being exposed to a thermoforming process. As can be seen by comparing FIGS. 2A and 2B, the first yarn 210 that comprises a thermoplastic polymeric composition as described herein was thermoformed from a solid yarn structure into a melted yarn component 212, with a core yarn 214 of the first yarn 210 still remaining in its interlooped configuration. In certain aspects, the heating step of the thermoforming process at least partly causes the coating in the first yarn 210 to melt and flow and then subsequently solidify by the completion of the thermoforming process into the melted yarn component 212. This melted yarn component 212 is the coating surrounding the core yarn 214 of the first yarn 210 after that coating is melted, flowed, and resolidifed. The melted yarn component 212 in FIG. 2B is depicted as contacting and at least partially surrounding the core yarn 214 of the first yarn 210 and contacting and at least partially surrounding a portion of the second yarn 208, at least on the portions of the first course 202 and the second course 204 that interloop with or are proximate to the third course 206 forming a network. However, the melted yarn component 212 may be thermoformed to spread to a greater extent or a lesser extent on the external-facing surface of the textile than depicted in FIG. 2B without departing from the technology described herein.

The areas with the melted yarn component 212 created from thermoforming may have increased abrasion resistance and increased water resistance properties compared to areas without a thermoformed melted yarn component 212. Further, because these properties are provided through the knit structure instead of being applied as an additional layer or film, the portion 200 of the knitted component may remain relatively thin and flexible. As such, the melted yarn component 212 may be utilized in high-flex areas of an upper, such as the area between the throat and the forefoot region, without premature wear or breakage.

Note that FIGS. 2A and 2B are merely examples of knitting and thermoforming as described herein. Other knit patterns with any plurality of adjacent rows, and/or any plurality of adjacent loops, of predominately the first yarn 210 or of predominately the second yarn 208 may be used for forming one of the first areas (such as first areas 108 of FIGS. 1A-1C) or the second areas (such as second areas 106 of FIGS. 1A-1C) on a surface of a knitted component as described herein without departing from the scope of the technology herein. For example, for simplicity of the illustration, portion 200 is shown with only a single knit layer. However, it is contemplated that some aspects of the disclosure may include a knitted component with a double knit structure formed using needles on two needle beds. For example, the first yarn 210 may be knit on a front needle bed to form the loops in the third course 206 in FIG. 2A, which may form the first surface of the knitted component, and in another course, such as a course knit simultaneously with the first course 202, the first yarn 210 may be knit on the back needle bed to form at least part of the second surface of the knitted component. Similarly, the second yarn 208 may be knit on a front needle bed to form the loops in the first course 202 and the second course 204 in FIG. 2A, which may form the first surface of the knitted component, and in another course, such as a course knit simultaneously with the third course 206, the second yarn 208 may be knit on the back needle bed to form at least part of the second surface of the knitted component. In some aspects, the first yarn 210 and/or the second yarn 208 may be moved back and forth between front and back needle beds within a single course. Additionally, in some aspects in which portion 200 is part of a double knit structure, loops forming courses for the second surface may be formed from a third yarn having an elastane or an elastic polyurethane material. Further, in some aspects having a double knit structure, the melted yarn component 212 may extend between the knit layers but not fully extend through the back layer to form the second surface. In alternative configurations, the melted yarn component 212 may still extend completely through both knit layers of a double knit structure.

Figure 3A:
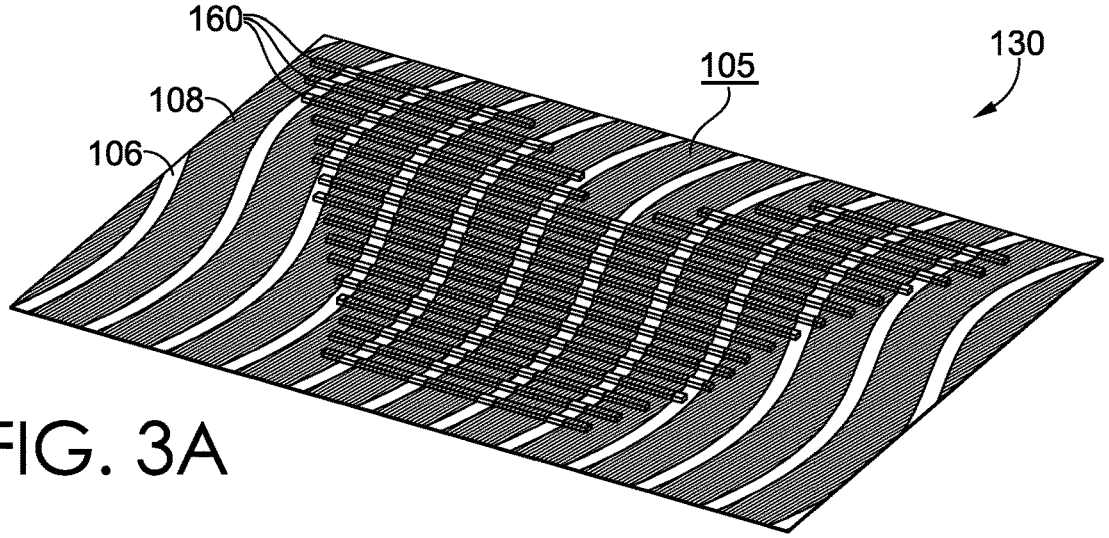
FIGS. 3A-3C depict exemplary perspective views of various protrusions and ridges molded into an external-facing surface of a knitted component, in accordance with aspects herein.
Figure 3B:
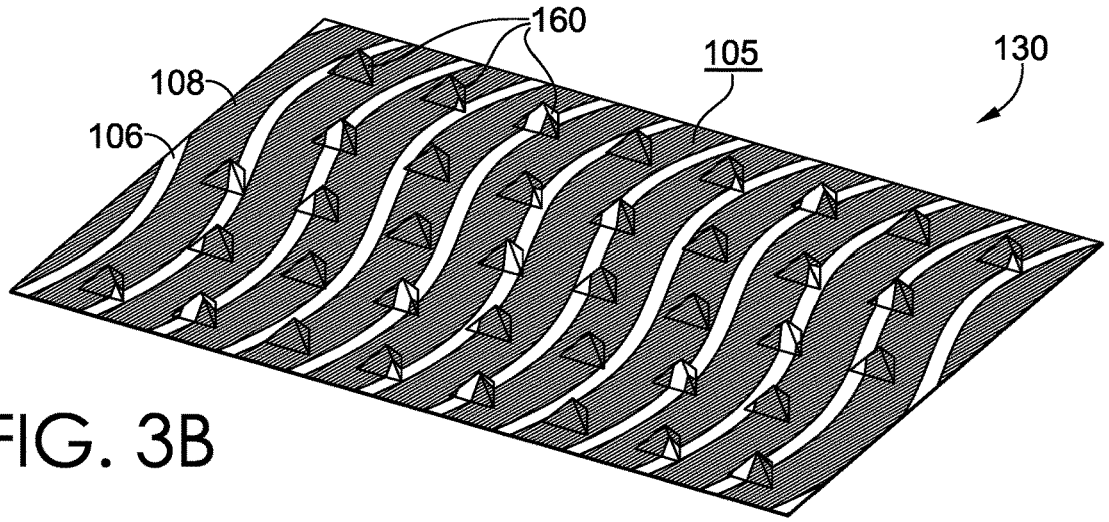
Figure 3C:
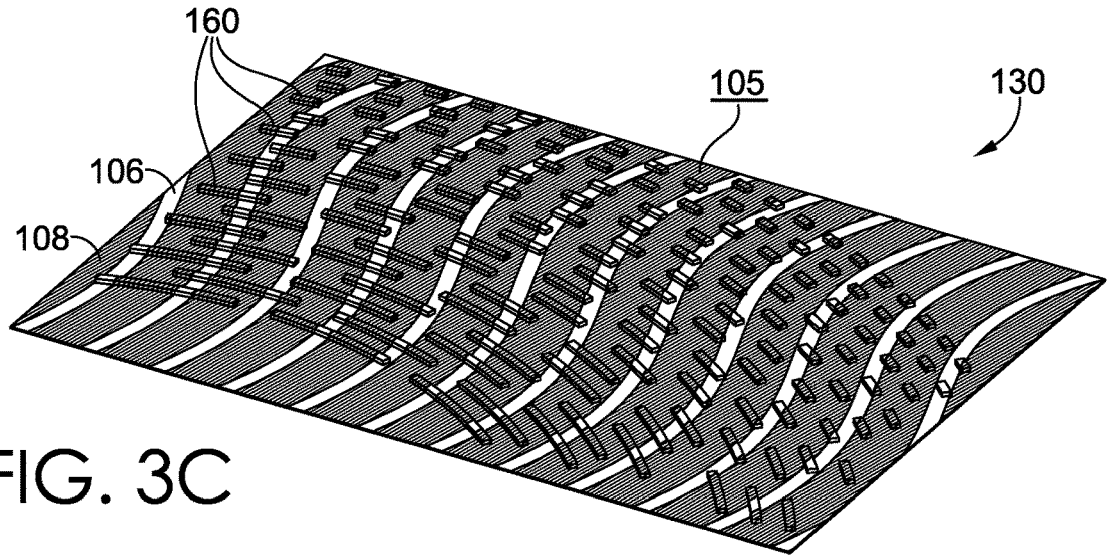

FIGS. 3A-3C each depict example external-facing surfaces of a knitted component thermoformed with various textures or patterns. This knitted component may be, for example, the knitted component 130 described herein having alternating first areas 108 and second areas 106, with the first areas 108 made of the first yarn and the second areas 106 made of the second yarn. Thermoforming of such knitted components may be used to reflow and resolidify the coating of the first yarn as described herein, such that the coating material then occupies at least a portion of spaces between yarns in the thermoformed network of yarns. As described further below, during thermoforming, pressure may be applied when the knitted component 130 is contacting a molding surface, such as a flat plate or a conventional two-piece mold. In some aspects, the molding surface may include recesses and/or raised elements to form a texture with raised elements on the first surface 105 of the knitted component 130. Raised elements molded into the knit structure of the knitted component 130 advantageously may be used to tune the gripping effect of the knitted component, such as the amount of grip between the first surface of the knitted component 130 (which may be the exterior surface of an upper) and a football. Specifically, raised elements mitigate the higher coefficient of friction (i.e., greater grip) of the first areas 108 due to the first yarn. As such, raised elements may be placed in portions of the knitted component 130 in which the first areas 108 form greater portions of the surface area. Additionally, in some aspects, raised elements may be located on the lateral side of the upper and not on the medial side, or the medial side of the upper may have less raised elements as the lateral side.

Raised elements 160 may take on various shapes, sizes and arrangements within the knitted component 130. In FIG. 3A, the raised elements 160 form elongated ridges or grooves tightly spaced together and extending parallel with each other. Within this example pattern, the ridges may have different lengths. Additionally, the ridges in FIG. 3A extend across both first areas 108 and second areas 106. Further, the ridges may extend substantially orthogonal to the longitudinal direction of the first areas 108 and the second areas 106. As the ridges may form recessed areas, similar to grooves, between the ridges, the ridges may also operate to allow moisture and other small debris to escape from the first surface 105 of the knitted component 130, which allows for a better contact surface with a ball and, in turn, better grip and/or ball control in wet and/or dirty conditions. Additionally, elongated parallel grooves on the lateral side of an upper may be particularly advantageous for dragging, nudging, and other such techniques. In some aspects, the grooves or recesses between the ridges are between or approximately between one millimeter and one centimeter in width and/or in spacing from each other. However, as described above, the pattern, width, and/or spacing of the ridges may be tweaked to tune grip and/or ball control as desired.

In FIG. 3B, the raised elements 160 are in the form of tetrahedron or pyramid-shaped protrusions extending from the first surface 105 of the knitted component 130. The protrusions in FIG. 3B may be positioned in both first areas 108 and second areas 106. In other aspects, the protrusions are located in only first areas 108. Additionally, the protrusions may be arranged in a generally linear pattern as shown in FIG. 3B or may be arranged in a more clustered or random pattern.

In FIG. 3C, the raised elements 160 form elongated ridges tightly spaced together. These ridges may be spaced substantially equidistance from each other. Additionally, the grooves may each be curved or arched. Within this example pattern, the ridges may have different lengths and may cooperatively form a slightly curved or curvilinear track of multiple rows and/or multiple columns of the elongated ridges or grooves. Similar to the raised elements 160 in FIG. 3A, the ridges in FIG. 3C extend across both first areas 108 and second areas 106. Further, the ridges may extend nearly orthogonal to the longitudinal direction of the first areas 108 and the second areas 106. As the ridges may form recessed areas, similar to grooves, between the ridges, the ridges may also operate to allow moisture and other small debris to escape for the first surface 105 of the knitted component 130, which allows for a better contact surface with a ball. In some aspects, the grooves or recesses between the ridges are between or approximately between one millimeter and one centimeter in width and/or in spacing from each other. Note that the raised elements 160 depicted in FIGS. 3A-3C are merely exemplary patterns, and the first surface 105 of the knitted component 130 may be thermoformed to have a flat, glossy, bumpy, or matte texture or pattern without departing from the scope of the technology described herein.

Figure 4:
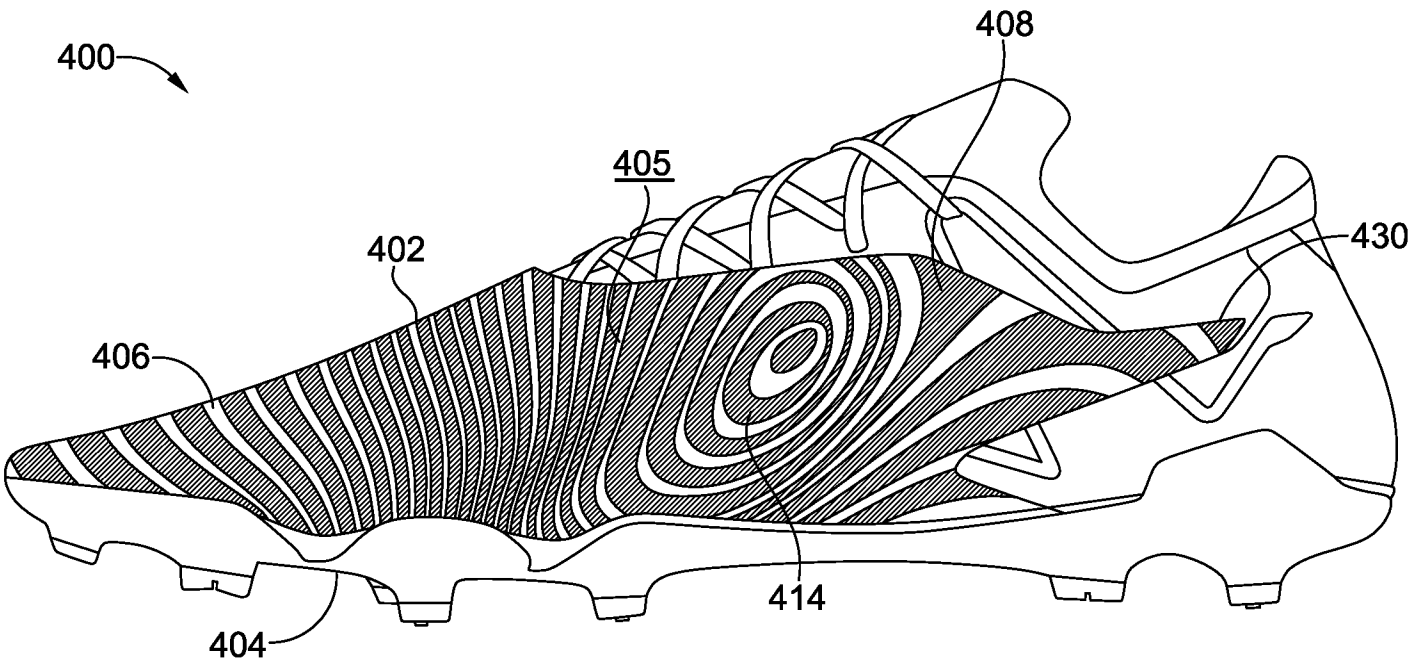
FIG. 4 is a medial side perspective view of another article of footwear, in accordance with aspects herein.
Figure 5A:
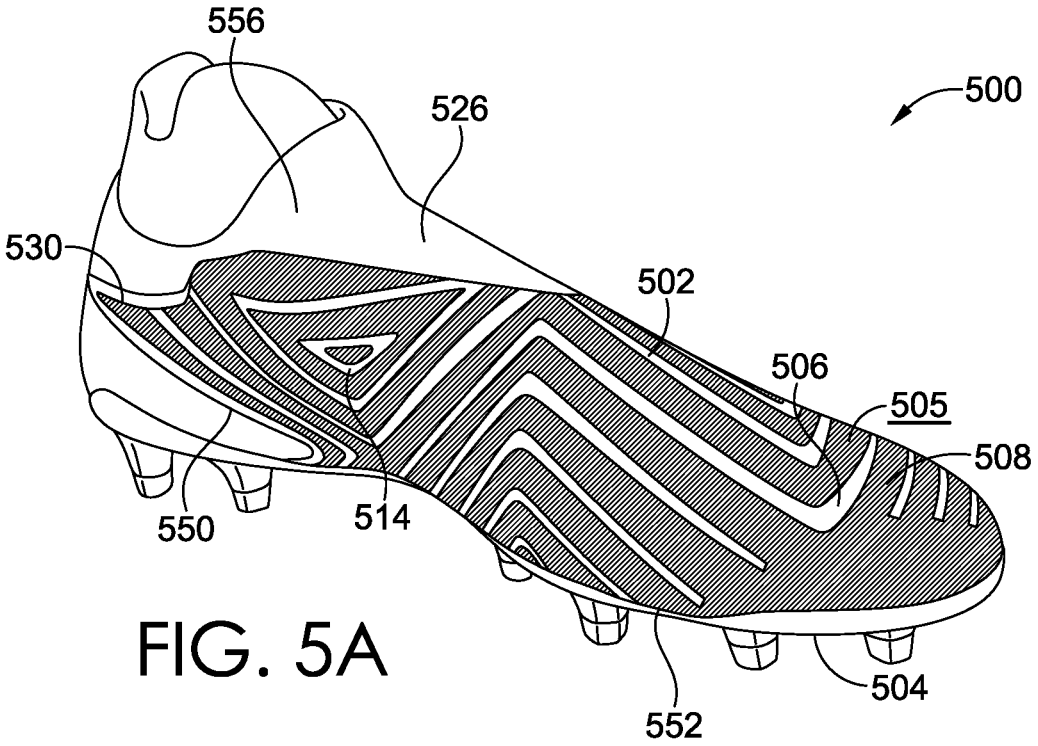
FIG. 5A is a lateral side perspective view of yet another alternative article of footwear, in accordance with aspects herein.
Figure 5B:
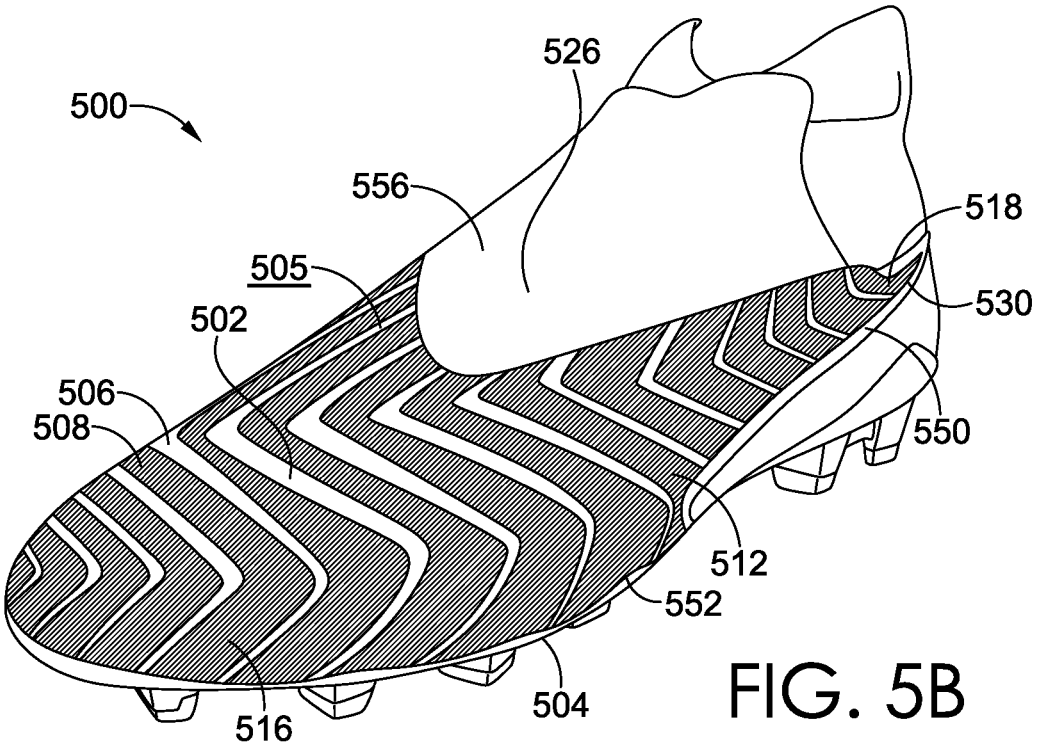
FIG. 5B is a medial side perspective view of the article of FIG. 5A, in accordance with aspects herein.

FIGS. 4 and 5A-5B depict aspects of a knitted component for an article of footwear having a different alternating pattern of first and second areas than what is shown in FIGS. 1A-1C. FIG. 4 depicts an article of footwear 400 having a sole structure 404 and an upper 402. Aspects of the sole structure 404 may have generally the same configurations described with respect to sole structure 104 of FIGS. 1A-1B. Additionally, aspects of the upper 402 may have generally the same configurations described with respect to the upper 102 of FIGS. 1A-1B. As such, the upper may be at least partially formed from a knitted component 430, and aspects of the knitted component 430 may have generally the same configuration described with respect to the knitted component 130 of FIGS. 1A-1B, with the exceptions noted below.

The knitted component 430 is formed from at least a first yarn and a second yarn having different material compositions and different properties. The knitted component 430 may be formed with materials and techniques discussed above in connection with component 130 of FIGS. 1A-1B. A first surface 405 of the knitted component 430 may form an external-facing surface of the upper and have a first plurality of areas (first areas 408) formed of the first yarn and a second plurality of areas (second areas 406) formed of the second yarn.

Similar to first areas 108 and second areas 106 of FIGS. 1A-1B, the first areas 408 and second areas 406 may have different coefficients of friction. For example, the wet and dry coefficients of friction for the first areas 408 may be greater than those for the second areas 406. Further, the first areas 408 and second areas 406 may be arranged in an alternating pattern at least on the medial side of the upper 402. Specifically, the first areas 408 and the second areas 406 may alternate to form a pattern of concentric shapes, such as irregularly-shaped circles and/or ovals. The central region of the concentric pattern may be positioned within the medial midfoot area 414. Unlike with the knitted component 130 of FIGS. 1A and 1B, the second areas 406 may not have a substantially greater width than the first areas 408 in the concentric shapes proximate to the central region. Rather, the concentric circles or ovals forming the first areas 408 in the central region may have a similar surface area as the surface area of the concentric circles or ovals forming the second areas 406 in the central region. As a result, the central region of the concentric pattern on the medial midfoot area 414 may provide greater grip than the central region of the concentric pattern on the lateral midfoot area 114*a* of FIG. 1B.

It should be understood that the first areas 408 and the second areas 406 may also form an alternating pattern on the lateral side of the upper, similar to the pattern described with respect to FIG. 1A. It should further be understood that at least some of the first areas 408 on the first surface 405 of the knitted component 430 may undergo thermoforming to create a thermoformed network similar to what was described for the knit portion 200 in FIGS. 2A and 2B. Additionally, in some aspects, the thermoformed first surface 405 may be molded to include raised structures within the first areas 408 and/or second areas 406. These raised structures may include any of the patterns described with respect to FIGS. 3A-3C.

FIGS. 5A and 5B depict another configuration of the alternating patterns in accordance with some aspects herein. FIGS. 5A and 5B depict an article of footwear 500 having a sole structure 504 and an upper 502. Aspects of the sole structure 504 may have generally the same configurations described with respect to sole structure 104 of FIGS. 1A-1B. Additionally, aspects of the upper 502 may have generally the same configurations described with respect to the upper 102 of FIGS. 1A-1B. As such the upper may be at least partially formed from a knitted component 530, and aspects of the knitted component 530 may have generally the same configuration, materials, and/or characteristics described with respect to the knitted component 130 of FIGS. 1A-1B with the exceptions noted below.

A first surface 505 of the knitted component 530 may form an external-facing surface of the upper (similar to the first surface 105 of FIGS. 1A-1B) and having a first plurality of areas (first areas 508) formed of the first yarn and a second plurality of areas (second areas 506) formed of the second yarn. Similar to first areas 108 and second areas 106 of FIGS. 1A-1B, the first areas 508 and second areas 506 may have different coefficients of friction. For example, the wet and dry coefficients of friction for the first areas 508 may be greater than those for the second areas 506.

Further, the first areas 508 and the second areas 506 may be arranged in an alternating pattern formed on concentric shapes on a medial side of the upper 502. Specifically, the first areas 508 and the second areas 506 may alternate to form a pattern of concentric triangular shapes in at least a medial midfoot 514 as illustrated in FIG. 5B. In some aspects, the concentric triangles may have rounded corners or pointed corners. In some aspects, the concentric pattern within the medial midfoot area 514 may be nested within a zig-zag pattern formed on a remainder of the knitted component 530, such as in a forefoot area 516, a heel area 518, and a lateral midfoot area 512 (shown in FIG. 5A).

The zig-zag pattern of the first areas 508 and the second areas 506 may be located on the lateral side of the upper 502. Within this pattern, the first areas 506 and the second areas 508 may generally extend from a bottom 550 of the knitted component 530 towards a throat area 526 of the upper 502. At least part of the bottom edge 550 of the knitted component 530 may align with the biteline 552 where the upper 502 joins the sole structure 454. The zig-zag stripes formed by alternating the first areas 508 and the second areas 506 on the lateral side may extend in the lateral midfoot area 512 as well as in the forefoot area 516. Further, in aspects in which the knitted component 530 extends to the heel area 518, the stripes may also extend in the heel area 518.

The zig-zag pattern may have various sizes. The stripes within the zig-zag pattern may be generally parallel to one another in some aspects. Furthermore, in some aspects, at least some points or angles of at least some stripes with the zig-zag pattern on the medial side may be aligned with at least one point or angle of an outer-most one of the concentric triangles in the medial midfoot area 514, such that the outer-most triangle is nested in an angle of one of the stripes of the zig-zag pattern.

Additionally, in the aspect depicted in FIGS. 5A and 5B, the upper 502 includes a textile component 556 forming the exterior of the throat area 526. This textile component 556 may act as an outer shroud to cover lacing and eyelets (similar to what is shown in FIGS. 1A and 1B). The textile component 556 may be integrally knit and have a unitary knit construction with the knitted component 530 with the first areas 508 and the second areas 506. Alternatively, the textile component may be formed separately from the knit component 503 and secured to the knit component 530 at one or more locations via stitching, bonding, or the like.

Figure 6:
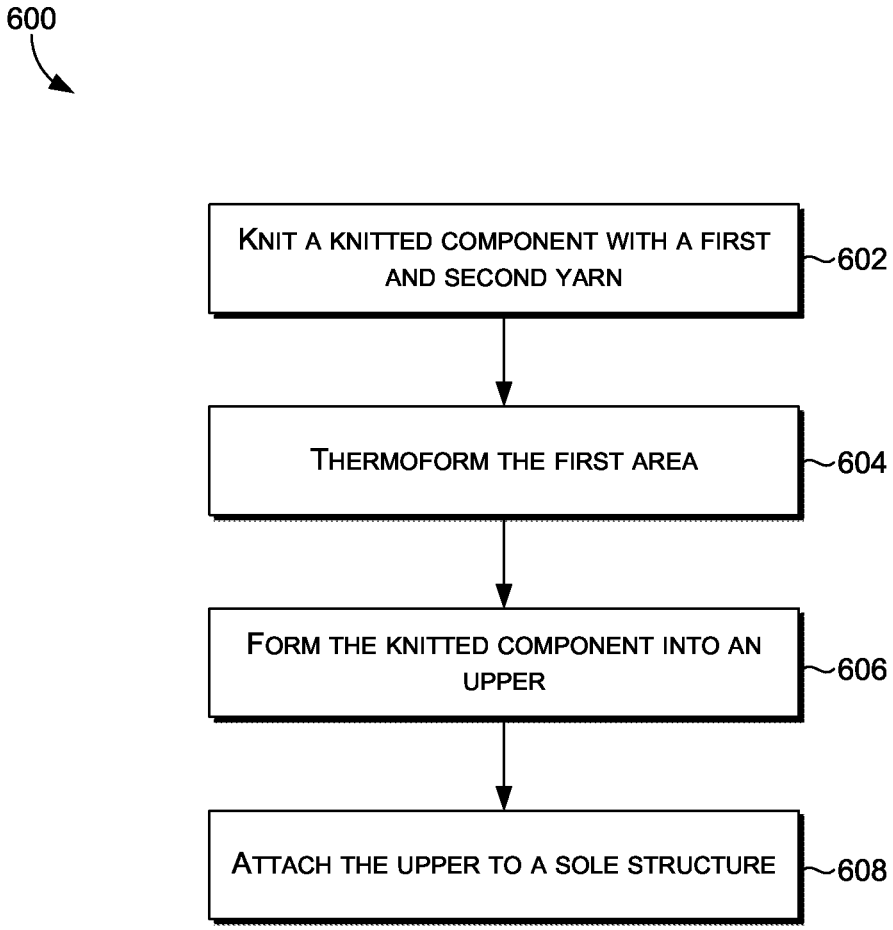
FIG. 6 depicts a flow chart of a method of forming a knitted component in accordance with the present disclosure.

FIG. 6 includes a flow diagram depicting an example method 600 of manufacturing a knitted component, such as the knitted components 130, 430 and/or 530 described above. The steps provided in method 600 are merely illustrative, and method 600 may include additional steps that are not illustrated. At least some of the steps of method 600 are indicated as being performed on a knitting machine, which may be an automated knitting machine. As such, one or more of these steps may be performed and/or controlled using a control unit having a processor or computer communicatively coupled with or integrated into the knitting machine. In example aspects, the knitting machine used to carry out steps of method 600 is a V-bed flat knitting machine having two needle beds—a front needle bed and a back needle bed—that are angled relative to each other to form a V-bed. However, it should be understood that this is one example and that other knitting machines may be used to form the knitted component or a portion thereof. Similarly, in example aspects, the knitting steps within method 600 may be weft-knitting processes, but in alternative aspects, warp-knitting processes may be used.

At block 602, the method 600 includes knitting a knitted component with a first yarn integrally knit with a second yarn. As described above, the first yarn may include a first core yarn and a first coating comprising a polymeric composition comprising one or more thermoplastic elastomers at least partially surrounding the first core yarn. Knitting the knitted component at block 602 may include knitting the first yarn such that the first yarn forms first areas on a first surface of the knitted component and knitting the second yarn such that the second yarn forms second areas on the first surface of the knitted component. To form the first areas, the first yarn may be looped around needles on a first (i.e., front) needle bed while the second yarn is floated behind the loops of the first yarn and/or forming loops around needles on the second (e.g., back) needle bed. To form the second areas, the second yarn may be looped around needles on the first needle bed while the first yarn is floated behind the loops of the second yarn and/or is forming loops around needles on the second needle bed. Example aspects of the first areas and second areas formed at block 602 may be any of the first areas and second areas described with respect to FIGS. 1A-5B. Additionally, method 600 may also include knitting a third yarn having elastane or an elastic polyurethane material on the second needle bed so that the third yarn forms a second (i.e., back or inner-facing) surface of the knitted component.

At block 604, the method 600 includes thermoforming at least the first areas of the knitted component such that the first coating of the first yarn flows and occupies at least a portion of spaces between courses of the first yarn or courses of the first core yarn. Additionally or alternatively, the thermoforming can allow the first coating to flow and occupy at least a portion of spaces between courses of the first core yarn and the second yarn. The thermoforming can cause the polymeric composition of the coating to create a thermoformed network of interlooped yarns comprising the first core yarn and a first polymeric composition surrounding at least a portion of the first core yarn and occupying spaces between at least some portions of the yarns in the thermoformed network. The thermoformed network may extend primarily through the first areas on the first surface of the knitted component, but it should be understood that at least portions of the second yarn forming the second areas of the knitted component may be contacting and at least partially surrounding the melted and re-solidified thermoplastic polymeric composition creating the thermoformed network.

Furthermore, the thermoforming step at block 604 includes increasing the temperature of the thermoplastic polymeric composition (i.e., the coating of the first yarn) to a temperature that causes at least a portion of the thermoplastic polymeric composition as described herein to melt and flow, or to deform. Further, the thermoforming process includes the subsequent decreasing of the temperature of the thermoplastic polymeric composition to solidify the reflowed thermoplastic polymeric composition as described herein into the desired conformation and/or shape, such as an article of footwear.

The knitted component may be thermoformed using a molding surface, such as a plate or a two-piece mold. The knitted component may be heated before contacting the molding surface or may be heated while contacting the molding surface. In certain aspects, the temperature of the thermoplastic polymeric composition may be increased for about 10 seconds to about 5 minutes. In aspects, the temperature of the thermoplastic polymeric composition may be increased for about 30 seconds to about 5 minutes. In one aspect, the temperature of the thermoplastic polymeric composition may be increased for about 30 seconds to about 3 minutes. Further, in some aspects, the thermoplastic polymeric composition may be exposed to the heating temperature multiple times prior to undergoing cooling.

For cooling, the knitted component may be moved to a cooling zone with reduced temperatures. Cooling allows the thermoplastic polymeric composition to resolidify in its reflowed location where it occupies at least a portion of spaces between courses of the first yarn and/or courses of the first core yarn. Furthermore, the first polymeric composition (e.g., a polymeric composition comprising a thermoplastic composition comprising a thermoplastic elastomer) may be cooled to resolidify in its reflowed location where it occupies at least a portion of spaces between courses of the first core yarn and the second yarn.

Further, in some aspects, pressure may be applied during or after application of heat. In certain aspects, the thermoforming exposes the materials on the mold surface to a pressure of about 50 kPa to about 300 kPa. In aspects, the thermoforming exposes the materials on the mold surface to a pressure of about 50 kPa to about 250 kPa. In one aspect, the thermoforming exposes the materials on the mold surface to a pressure of about 100 kPa to about 300 kPa.

In some aspects of method 600, a texturized molding surface may be used to impart a three-dimensional texture on the first surface of the knitted component. For example, through application of heat and, optionally pressure, the texturized molding surface may cause the melted thermoplastic polymeric composition to form raised elements in the first surface. The raised elements may be in any of the forms or patterns described with respect to FIGS. 3A-3C. The texturized molding surface may be used for a first application of heat during thermoforming or a subsequent application of heat.

By selectively incorporating the first yarn (having the coating comprising the thermoplastic polymer) into the knitted component into the first areas via knitting prior to thermoforming, the manufacturing process may be streamlined. Specifically, it enables the entire knitted component to be exposed during thermoforming without the need to mask or protect certain areas (i.e., second areas) while maintaining selective placement of the thermoformed network, thereby resulting in a more time and energy efficient manufacturing process.

In some aspects, method 600 includes, at block 606, forming the knitted component into an upper. The knitted component may already be knit to the shape of an upper and may be formed into an upper by folding one or more portions and/or joining one or more edges to create a foot-receiving void. In some aspects, the knitted component may be a larger textile piece and cut to the shape of the upper or to the shape of a component of the upper, such as an outer sheath. In some aspects, block 606 includes securing the thermoformed knitted component to one or more textile components by stitches, bonding, or the like.

In some aspects, the method 600 may include a step of attaching the upper or another such thermoformed knitted component to a sole structure, as shown in block 608. The attaching may be accomplished via the thermoforming together of the upper or knitted component and the sole structure and/or may be accomplished via mechanical techniques or other attaching techniques known in the art.

Example Properties of the First Yarn

As discussed above, textiles and shaped components may include the selective incorporation of yarns (referred to above as a first yarn) as described alone or in combination with other materials (e.g., second yarns that do not fall under the fibers, filaments, and yarns described herein). In certain aspects, the yarns and/or fibers described herein may be used to provide a specific functionality. For example, in certain aspects, yarn as described herein may be thermoformed to form a film having water-proof or water-resistant properties.

In one aspect, coated yarns, such as the first yarn, described herein have a break strength of about 0.6 to about 0.9 kilograms of applied force, or of about 0.7 to about 0.9 kilograms of applied force, or of about 0.8 to about 0.9 kilograms of applied force, or greater than 0.9 kilograms of applied force.

In an aspect, the yarns described herein are produced from fibers or filaments composed of only a single thermoplastic elastomer. In other aspects, the fibers are composed of a blend of two or more different thermoplastic elastomers.

In one aspect, the yarn is a coated yarn, wherein a core yarn comprises a second polymeric composition and a coating layer disposed on the core yarn, the coating layer comprising the first polymeric composition, wherein the first polymeric composition has a first melting temperature. In one aspect, the second polymeric composition is a second thermoplastic composition having a second deformation temperature, and the second deformation temperature is at least 20 degrees Celsius greater, at least 50 degrees Celsius greater, at least 75 degrees Celsius greater, or at least 100 degrees Celsius greater than the first melting temperature of the first polymeric composition. In another aspect, the second polymeric composition is a second thermoplastic composition having a second melting or deformation temperature, and the second deformation temperature is at about 20 degrees Celsius greater, about 50 degrees Celsius greater, about 75 degrees Celsius greater, or about 100 degrees Celsius greater than the first melting temperature of the first polymeric composition.

In one aspect, the first polymeric composition includes a polymeric component. In one aspect, the first polymeric composition may include a single polymeric component (e.g., a single thermoplastic elastomer). In other aspects, the first polymeric composition may include two or more polymeric components (e.g., two or more different thermoplastic elastomers).

In one aspect, the second polymeric composition is a first thermoset composition. In one aspect, the second polymeric composition comprises a second thermoset composition. The core yarn may be any material which retains its strength at the temperature at which the first polymeric material is extruded during the coating process. The core yarn may be natural fibers or regenerated fibers or filaments, or synthetic fibers or filaments. In one aspect, the core yarn may be composed of a cotton, silk, wool, rayon, nylon, elastane, polyester, polyamide, polyurethane, or polyolefin. In one aspect, the core yarn is composed of polyethylene terephthalate (PET). In one aspect, the second polymeric composition has a deformation temperature greater than 200 degrees Celsius, greater than 220 degrees Celsius, greater than 240 degrees Celsius, or between about 200 degrees Celsius to about 300 degrees Celsius.

In one aspect, the core yarn is a staple yarn, a multi-filament yarn or a mono-filament yarn. In one aspect the core yarn is polytwisted. In one aspect, the core yarn has a linear density of about 100 denier to about 300 denier, or of about 100 to about 250 denier, or about 100 to about 200 denier, or about 100 to 150 denier, or about 150 to 300 denier, or about 200 to 300 denier, or about 250 to 300 denier. In one aspect, the core yarn has a thickness of about 60 microns to 200 microns, about 60 to 160 microns, about 60 to 120 microns, about 60 to 100 microns, about 100 to 200 microns, or about 140 to 200 microns.

In one aspect, the core yarn is polyethylene terephthalate having a thickness of about 100 denier to about 200 denier, about 125 denier to about 175 denier, or about 150 denier to 160 denier. In one aspect, the core yarn is polyethylene terephthalate having a percent elongation of about 20 percent to about 30 percent, about 22 percent to about 30 percent, about 24 percent to about 30 percent, about 20 percent to about 28 percent, or about 20 percent to about 26 percent. In one aspect, the core yarn is polyethylene terephthalate having a tenacity of about 1 gram per denier to about 10 grams per denier, about 3 grams to about 10 grams per denier, about 5 grams to about 10 grams per denier, about 1 gram to about 7 grams per denier, or about 1 gram to about 5 grams per denier.

In one aspect, the coated yarn may be produced by extruding the coating (i.e., the first polymeric composition) onto the core yarn through an annular die or orifice such that the coating layer is axially centered surrounding the core yarn. The thickness of the coating applied to the core yarn may vary depending upon the application of the yarn. In one aspect, the coated yarn is used to produce a knitted textile. In one aspect, the coated yarn has a nominal average outer diameter of up to 1.00 millimeter, or of up to about 0.75 millimeters, or of up to about 0.5 millimeters, or of up to about 0.25 millimeters, or of up to about 0.2 millimeters, or of up to about 0.1 millimeters. In another aspect, the coating has a nominal average outer diameter of about 0.1 millimeters to about 1.00 millimeter, or about 0.1 millimeters to about 0.80 millimeters, or about 0.1 millimeters to about 0.60 millimeters. In another aspect, the coating on the yarn has an average radial coating thickness of about 50 micrometers to about 200 micrometers, or about 50 micrometers to about 150 micrometers, or about 50 micrometers to about 125 micrometers.

In one aspect, the core yarn has a thickness of about 100 denier to about 200 denier, about 125 denier to about 175 denier, or about 150 denier to 160 denier, and the coating has a nominal average outer diameter of about 0.10 millimeters to about 0.50 millimeters, or of about 0.10 millimeters to about 0.25 millimeters, or of about 0.10 millimeters to about 0.20 millimeters. In one aspect, the core yarn is polyethylene terephthalate having a thickness of about 100 denier to about 200 denier, about 125 denier to about 175 denier, or about 150 denier to about 160 denier, and the coating has a nominal average outer diameter of about 0.10 millimeters to about 0.50 millimeters, or of about 0.10 millimeters to about 0.25 millimeters, or of about 0.10 millimeters to about 0.20 millimeters.

In a further aspect, the coated yarn has a net total diameter of from about 0.2 to about 0.6 millimeters, or about 0.3 to about 0.5 millimeters, or about 0.4 to about 0.6 millimeters In some aspects, a lubricating oil including, but not limited to, mineral oil or silicone oil, is present on the yarn at from about 0.5 percent to about 2 percent by weight, or from about 0.5 percent to about 1.5 percent by weight, or from about 0.5 percent to about 1 percent by weight. In some aspects, lubricating compositions are applied to the surface of the coated yarn before or during the process of forming the textile. In some aspects, the thermoplastic composition and the lubricating composition are miscible when the thermoplastic composition is reflowed and resolidified in the presence of the lubricating composition. Following reflowing and resolidification, the reflowed and solidified composition may comprise the lubricating composition.

In one aspect, the core yarn has a percent elongation of about 8 percent to about 30 percent, about 10 percent to about 30 percent, about 15 percent to about 30 percent, about 20 percent to about 30 percent, about 10 percent to about 25 percent, or about 10 percent to about 20 percent. In one aspect, the core yarn has a tenacity of about 1 gram per denier to about 10 grams per denier, about 2 grams per denier to about 8 grams per denier, about 4 grams per denier to about 8 grams per denier, or about 2 grams per denier to about 6 grams per denier.

In one aspect, when thermoformed, the polymeric composition of the first coating has a melting temperature from about 100 degrees Celsius to about 210 degrees Celsius, optionally from about 110 degrees Celsius to about 195 degrees Celsius, from about 120 degrees Celsius to about 180 degrees Celsius, or from about 120 degrees Celsius to about 170 degrees Celsius. In another aspect, the first polymeric composition has a melting temperature greater than about 120 degrees Celsius and less than about 170 degrees Celsius, and optionally greater than about 130 degrees Celsius, and less than about 160 degrees Celsius.

In a further aspect, when the melting temperature is greater than 100 degrees Celsius, the integrity of articles formed from or incorporating the first polymeric composition is preserved if the articles briefly encounter similar temperatures, for example, during shipping or storage. In another aspect, when the melting temperature is greater than 100 degrees Celsius, or greater than 120 degrees Celsius, articles formed from or incorporating the first polymeric composition may be steamed without melting or uncontrollably fusing any polyester components incorporated in the articles for purposes such as fill, zonal surface, or comfort features, as well as stretch yarn used for snugness and fit features.

In one aspect, when the melting temperature is greater than 120 degrees Celsius, materials incorporating the first or second polymeric composition disclosed herein are unlikely to soften and/or become tacky during use on a hot paved surface, a court surface, an artificial or natural football pitch, or a similar playing surface, track, or field. In one aspect, the higher the melting temperature of the first or second polymeric composition and the greater its enthalpy of melting, the greater the ability of an article of footwear or athletic equipment incorporating or constructed from the first or second polymeric composition to withstand contact heating excursions, frictional surface heating events, or environmental heating excursions. In one aspect, such heat excursions may arise when the articles contact hot ground, court, or turf surfaces, or from frictional heating that comes from rubbing or abrasion when the articles contact another surface such as the ground, another shoe, a ball, or the like.

In another aspect, when the melting temperature is less than about 210 degrees Celsius, or less than about 200 degrees Celsius, or less than about 190 degrees Celsius, or less than about 180 degrees Celsius, or less than about 175 degrees Celsius, but greater than about 120 degrees Celsius, or greater than about 110 degrees Celsius, or greater than about 103 degrees Celsius, polymer coated yarns may be melted for the purposes of molding and/or thermoforming a given region of textiles knitted therefrom in order to impart desirable design and aesthetic features in a short period of time.

In one aspect, a melting temperature lower than 140 degrees Celsius prevents or mitigates the risk dye migration from polyester yarns incorporated in the footwear or other articles. In a further aspect, dye migration from package-dyed polyester yarns or filaments is a diffusion-limited process and short periods of exposure to temperatures greater than 140 degrees Celsius, such as during thermoforming, do not extensively damage, discolor, or otherwise render the appearance of the footwear or other articles unacceptable. However, in another aspect, if the melting temperature of the polymer coating is greater than about 210 degrees Celsius, thermal damage and dye migration may occur.

In one aspect, a high melting enthalpy indicates a longer heating time is required to ensure a polymer is fully melted and will flow well. In another aspect, a low melting enthalpy requires less heating time to ensure full melting and good flow.

In a further aspect, high cooling exotherms indicate rapid transitions from molten to solid. In another aspect, higher recrystallization temperatures indicate polymers are capable of solidifying at higher temperatures. In one aspect, high-temperature solidification is beneficial for thermoforming. In one aspect, recrystallization above 95 degrees Celsius promotes rapid setting after thermoforming, reduces cycle time, reduces cooling demands, and improves stability of shoe components during assembly and use.

In one aspect, viscosity of the coating compositions disclosed herein affects the properties and processing of the coating compositions. In a further aspect, high viscosities at low shear rates (e.g., less than 1 reciprocal second) indicate resistance to flow, displacement, and more solid-like behavior. In another aspect, low viscosities at higher shear rates (e.g., greater than 10 reciprocal seconds) lend themselves to high-speed extrusion. In one aspect, as viscosity increases, the ability to flow and deform adequately to coat core yarn substrate becomes challenging. In another aspect, materials that exhibit high shear thinning indices (e.g., where viscosity at 10 or 100 reciprocal seconds is lower than at 1 reciprocal second) may be challenging to extrude and may melt fracture if coated or extruded at a velocity that is too high.

In one aspect, the composition forming the first areas has a durometer Shore A hardness of about 50 to about 90 Shore A, optionally from about 55 to about 85 Shore A, from about 60 to about 80 Shore A, from about 60 to about 70 Shore A, or from about 67 to about 77 shore A.

In various aspects, the first polymeric composition for coating yarn has a cold Ross flex test result of about 120,000 to about 180,000, or of about 140,000 to about 160,000, or of about 130,000 to about 170,000 when tested on a thermoformed plaque of the first polymeric composition for coating yarn in accordance with the cold Ross flex test as described herein below.

In one aspect, the polymeric composition or coating of the first yarn or the first areas have two or more of the first properties, or optionally three or more, four or more, five or more, six or more, seven or more, or all ten first properties provided above.

In addition to the first properties, when thermoformed, the first coating or polymeric composition of the first yarn or the first areas has one or more second properties. In one aspect, when thermoformed, the first coating or polymeric composition of the first yarn or the first areas has a glass transition temperature less than 50 degrees Celsius, optionally less than 30 degrees Celsius, less than 0 degrees Celsius, less than −10 degrees Celsius, less than −20 degrees Celsius, or less than −30 degrees Celsius. In one aspect, when thermoformed, the first coating or polymeric composition of the first yarn or the first areas has a stress at break greater than 7 megapascals, optionally greater than 8 megapascals, as determined using the Modulus, Tenacity, and Elongation Test, at 25 degrees Celsius. In one aspect, when thermoformed, the first coating or polymeric composition of the first yarn or the first areas has a tensile stress at 300 percent modulus greater than 2 megapascals, optionally greater than 2.5 megapascals, or greater than 3 megapascals, as determined using the Modulus, Tenacity, and Elongation Test, at 25 degrees Celsius. In one aspect, when thermoformed, the first coating or polymeric composition of the first yarn or first areas has an elongation at break greater than 400 percent, optionally greater than 450 percent, optionally greater than 500 percent, or greater than 550 percent, as determined using the Modulus, Tenacity, and Elongation Test, at 25 degrees Celsius. In another aspect, when thermoformed, the first coating or polymeric composition of the first yarn or the first areas has two or more of the second properties, or optionally three or more, or all four second properties.

In certain aspects, the films, fibers, and yarns described herein can exhibit a tenacity greater than 1 gram/denier. In one aspect, the films, fibers, and yarns described herein can exhibit a tenacity of from about 1 gram/denier to about 5 grams/denier. In one or more aspects, the films, fibers, and yarns described herein can exhibit a tenacity of from about 1.5 grams/denier to about 4.5 grams/denier. In one aspect, the films, fibers, and yarns described herein can exhibit a tenacity of from about 2 grams/denier to about 4.5 grams/denier. "Tenacity" as used herein refers to a property of a fiber or yarn, and is determined using the respective testing method and sampling procedure described as follows. Specifically, tenacity and elongation of the yarn sample are determined according to the test method detailed in EN ISO 2062 with the pre-load set to 5 grams. Elongation is recorded at the maximum tensile force value applied prior to breaking. Tenacity can be calculated as the ratio of load required to break the specimen to the linear density of the specimen.

In certain aspects, it may be desired to utilize a yarn that is suitable for use on commercial knitting equipment. A free-standing shrinkage of a yarn at 50 degrees Celsius is one property that can be predictive of a suitable yarn for use on a commercial knitting machine. In certain aspects, the films, fibers, filaments, and yarns described herein can exhibit a freestanding shrinkage when heated from 20 degrees Celsius to 70 degrees Celsius of less than 15 percent. In various aspects, the films, fibers, and yarns described herein can exhibit freestanding shrinkage when heated from 20 degrees Celsius to 70 degrees Celsius of about 0 percent to about 60 percent, about 0 percent to about 30 percent, or about 0 percent to about 15 percent. The term "free-standing shrinkage" as used herein refers to a property of a yarn and a respective testing method described as follows:

Yarn Shrinkage Test. The free-standing shrinkage of yarns can be determined by the following method. A yarn sample is prepared according to the Yarn Sampling Procedure described below, and is cut to a length of approximately 30 millimeters with minimal tension at approximately room temperature (e.g., 20 degrees Celsius). The cut sample is placed in a 50 degrees Celsius or 70 degrees Celsius oven for 90 seconds. The sample is removed from the oven and measured. The percentage of shrink is calculated using the pre- and post-oven measurements of the sample, by dividing the post-oven measurement by the pre-oven measurement, and multiplying by 100.

Yarn Sampling Procedure. Yarn to be tested is stored at room temperature (20 degrees Celsius to 24 degrees Celsius) for 24 hours prior to testing. The first 3 meters of material are discarded. A sample yarn is cut to a length of approximately 30 millimeters with minimal tension at approximately room temperature (e.g., 20 degrees Celsius).

In one or more aspects, the free-standing shrinkage of a yarn at 70 degrees Celsius can be a useful indicator of the ability of a yarn to be exposed to certain environmental conditions without any substantial changes to the physical structure of the yarn. In certain aspects, a yarn comprising the low processing temperature polymeric composition can exhibit a free-standing shrinkage when heated from 20 degrees Celsius to 70 degrees Celsius of from about 0% to about 60%. In one or more aspects, a yarn comprising the low processing temperature polymeric composition can exhibit a free-standing shrinkage when heated from 20 degrees Celsius to 70 degrees Celsius of from about 0% to about 30%. In one aspect, a yarn comprising the low processing temperature polymeric composition can exhibit a freestanding shrinkage when heated from 20 degrees Celsius to 70 degrees Celsius of from about 0% to about 20%.

As discussed above, in certain aspects, the first polymeric composition as described herein and the second polymeric composition have differing properties. In various aspects, these differing properties allow for the coated fibers as described herein, during a thermoforming process, to melt and flow, and subsequently cool and solidify into a different structure than that prior to the thermoforming process (e.g., thermoform from a yarn to a melted yarn component), while an uncoated fiber cannot deform or melt during such a process and can maintain its structure (e.g., as a yarn), when the thermoforming process is conducted at a temperature below the melting temperature of the uncoated fibers. In such aspects, the melted yarn component formed from the coated fibers as described herein during the thermoforming process may be integrally connected to the non-altered structure (e.g., a yarn or fiber), which can provide three-dimensional structure and/or other properties targeted to specific spots on an article of wear.

Example Thermoplastic Elastomers

In various aspects, the polymeric compositions for the coating of the first yarn described herein comprise one or more thermoplastic elastomers. In an aspect, an "elastomer" is defined as a material having an elongation at break greater than 400 percent as determined using ASTM D-412-98 at 25 degrees Celsius. In another aspect, the elastomer is formed into a plaque, wherein the plaque has a break strength of from 10 to 35 kilogram-force (kgf), or of from about 10 to about 25 kilogram-force, or of from about 10 to about 20 kilogram-force, or of from about 15 to about 35 kilogram-force, or of from about 20 to about 30 kilogram-force. In another aspect, tensile breaking strength or ultimate strength, if adjusted for a cross-sectional area, is greater than 70 kilogram·force per square centimeter, or greater than 80 kilogram·force per square centimeter. In another aspect, the elastomer plaque has a strain to break of from 450 percent to 800 percent, or from 500 to 800 percent, or from 500 to 750 percent, or from 600 to 750 percent, or from 450 to 700 percent. In still another aspect, the elastomer plaque has a load at 100 percent strain of from 3 to 8 kilogram-force per millimeter, or of about 3 to about 7 kilogram-force per millimeter, about 3.5 to about 6.5 kilogram-force per millimeter, or about 4 to about 5 kilogram-force per millimeter. In one aspect, the elastomer plaque has a toughness of from 850 kilogram·millimeters to 2200 kilogram·millimeters, or of from about 850 kilogram·millimeters to about 2000 kilogram·millimeters, or of from about 900 kilogram·millimeters to about 1750 kilogram·millimeters, or of from about 1000 kilogram·millimeters to about 1500 kilogram·millimeters, or of from about 1500 kilogram·millimeters to about 2000 kilogram·millimeters. In an aspect, the elastomer plaque has a stiffness of from about 35 to about 155, or of from about 50 to about 150, or of from about 50 to about 100, or of from about 50 to about 75, or of from about 60 to about 155, or of from about 80 to about 150. In still another aspect, the elastomer plaque has a tear strength of from about 35 to about 80, or of from about 35 to about 75, or of from about 40 to about 60, or of from about 45 to about 50.

In aspects, exemplary thermoplastic elastomers include homo-polymers and copolymers. The term "polymer" refers to a polymerized molecule having one or more monomer species, and includes homopolymers and copolymers. The term "copolymer" refers to a polymer having two or more monomer species, and includes terpolymers (i.e., copolymers having three monomer species). In certain aspects, the thermoplastic elastomer is a random co-polymer. In one aspect, the thermoplastic elastomer is a block co-polymer. For example, the thermoplastic elastomer may be a block co-polymer having repeating blocks of polymeric units of the same chemical structure (segments) which are relatively harder (hard segments), and repeating blocks of polymeric segments which are relatively softer (soft segments). In various aspects, in block co-polymers, including block co-polymers having repeating hard segments and soft segments, physical crosslinks may be present within the blocks or between the blocks or both within and between the blocks. Particular examples of hard segments include isocyanate segments and polyamide segments. Particular examples of soft segments include polyether segments and polyester segments. As used herein, the polymeric segment may be a particular type of polymeric segment such as, for example, an isocyanate segment, a polyamide segment, a polyether segment, a polyester segment, and the like. It is understood that the chemical structure of the segment is derived from the described chemical structure. For example, an isocyanate segment is a polymerized unit including an isocyanate functional group. When referring to a block of polymeric segments of a particular chemical structure, the block may contain up to 10 mol percent of segments of other chemical structures. For example, as used herein, a polyether segment is understood to include up to 10 mol percent of non-polyether segments.

In one aspect, the first polymeric composition comprises a polymeric component consisting of all the polymers present in the polymeric composition; optionally wherein the polymeric component comprises two or more polymers, wherein the two or more polymers differ from each other in chemical structure of individual segments of each of the two or more polymers, or in molecular weight of each of the two or more polymers, or in both.

In various aspects, the thermoplastic elastomer may include one or more of a thermoplastic copolyester elastomer, a thermoplastic polyether block amide elastomer, a thermoplastic polyurethane elastomer, a polyolefin based-copolymer elastomer, a thermoplastic styrenic copolymer elastomer, a thermoplastic ionomer elastomer, or any combination thereof. In one aspect, the first polymeric composition comprises a thermoplastic elastomeric styrenic copolymer. In a further aspect, the thermoplastic elastomeric styrenic copolymer may be a styrene butadiene styrene (SBS) block copolymer, a styrene ethylene/butylene styrene (SEBS) resin, a styrene acrylonitrile (SAN) resin, or any combination thereof. In one aspect, a polymeric composition comprises a thermoplastic elastomeric polyester polyurethane, a thermoplastic polyether polyurethane, or any combination thereof. In some aspects, the thermoplastic elastomeric polyester polyurethane may be an aromatic polyester, an aliphatic composition, or a combination thereof. It should be understood that other thermoplastic polymeric materials not specifically described below are also contemplated for use in the coated fiber as described herein and/or an uncoated fiber. In one aspect, a polymeric composition comprises a thermoplastic elastomer that has a melting temperature greater than about 110 degrees Celsius and less than about 170 degrees Celsius. In another aspect, a polymeric composition comprising a thermoplastic elastomer has a melting temperature of about 110 degrees Celsius to about 170 degrees Celsius, about 115 degrees Celsius to about 160 degrees Celsius, about 120 degrees Celsius to about 150 degrees Celsius, about 125 degrees Celsius to about 140 degrees Celsius, about 110 degrees Celsius to about 150 degrees Celsius, or about 110 degrees Celsius to about 125 degrees Celsius.

In various aspects, the thermoplastic elastomer has a glass transition temperature (Tg) less than 50 degrees Celsius when determined in accordance with ASTM D3418-97 as described herein below. In some aspects, the thermoplastic elastomer has a glass transition temperature (Tg) of about −60 degrees Celsius to about 50 degrees Celsius, about −25 degrees Celsius to about 40 degrees Celsius, about −20 degrees Celsius to about 30 degrees Celsius, about −20 degrees Celsius to about 20 degrees Celsius, or of about −10 degrees Celsius to about 10 degrees Celsius, when determined in accordance with ASTM D3418-97 as described herein below. In one aspect, the glass transition temperature of the thermoplastic elastomer is selected such that in articles incorporating the coated yarns disclosed herein, wherein the coated yarns comprise a coating material comprising the thermoplastic elastomer, the thermoplastic material is above its glass transition temperature during normal wear when incorporated into an article of footwear (i.e., is more rubbery and less brittle).

In one aspect, the thermoplastic elastomer comprises: (a) a plurality of first segments; (b) a plurality of second segments; and, optionally, (c) a plurality of third segments. In various aspects, the thermoplastic elastomer is a block copolymer. In some aspects, the thermoplastic elastomer is a segmented copolymer. In further aspects, the thermoplastic elastomer is a random copolymer. In still further aspects, the thermoplastic elastomer is a condensation copolymer.

In a further aspect, the thermoplastic elastomer has a weight average molecular weight of about 50,000 Daltons to about 1,000,000 Daltons; about 50,000 Daltons to about 500,000 Daltons; about 75,000 Daltons to about 300,000 Daltons; or about 100,000 Daltons to about 200,000 Daltons.

In a further aspect, the thermoplastic elastomer has a ratio of first segments to second segments from about 1:1 to about 1:2 based on the weight of each of the first segments and the second segments; or of about 1:1 to about 1:1.5 based on the weight of each of the first segments and the second segments.

In a further aspect, the thermoplastic elastomer has a ratio of first segments to third segments from about 1:1 to about 1:5 based on the weight of each of the first segments and the third segments; about 1:1 to about 1:3 based on the weight of each of the first segments and the third segments; about 1:1 to about 1:2 based on the weight of each of the first segments and the third segments; or about 1:1 to about 1:3 based on the weight of each of the first segments and the third segments.

In a further aspect, the thermoplastic elastomer has first segments derived from a first component having a number-average molecular weight of about 250 Daltons to about 6000 Daltons; about 400 Daltons to about 6,000 Daltons; about 350 Daltons to about 5,000 Daltons; or about 500 Daltons to about 3,000 Daltons.

In some aspects, the thermoplastic elastomer comprises phase separated domains. For example, a plurality of first segments can phase-separate into domains comprising primarily the first segments. Moreover, a plurality of second segments derived from segments having a different chemical structure can phase-separate into domains comprising primarily the second segments. In some aspects, the first segments can comprise hard segments, and the second segments can comprise soft segments. In other aspects, the thermoplastic elastomer can comprise phase-separated domains comprising a plurality of first copolyester units.

In one aspect, prior to thermoforming, a polymeric composition has a glass transition temperature of from about 20 degrees Celsius to about −60 degrees Celsius. In one aspect, prior to thermoforming, a polymeric composition has a Taber Abrasion Resistance of from about 10 milligrams to about 40 milligrams as determined by ASTM D3389. In one aspect, prior to thermoforming, a polymeric composition has a Durometer Hardness (Shore A) of from about 60 to about 90 as determined by ASTM D2240. In one aspect, prior to thermoforming, a polymeric composition has a specific gravity of from about 0.80 g/cm3 to about 1.30 g/cm$^3$ as determined by ASTM D792. In one aspect, prior to thermoforming, a polymeric composition has a melt flow index of about 2 grams/10 minutes to about 50 grams/10 minutes at 160 degrees Celsius using a test weight of 2.16 kilograms. In one aspect, prior to thermoforming, a polymeric composition has a melt flow rate greater than about 2 grams/10 minutes at 190 degrees Celsius or 200 degrees Celsius when using a test weight of kilograms. In one aspect, prior to thermoforming, a polymeric composition has a modulus of about 1 megapascal to about 500 megapascals.

Example Thermoplastic Polyurethane Elastomers

In certain aspects, the thermoplastic elastomer, as used for the coating of the first yarn in some aspects herein, is a thermoplastic polyurethane (TPU) elastomer. The thermoplastic polyurethane elastomer may be a thermoplastic block polyurethane co-polymer. The thermoplastic polyurethane co-polymer may be a copolymer comprising hard segments and soft segments, including blocks of hard segments and blocks of soft segments. The hard segments may comprise or consist of isocyanate segments. In the same or alternative aspects, the soft segments may comprise or consist of polyether segments, or polyester segments, or a combination of polyether segments and polyester segments. In one aspect, the thermoplastic material, or the polymeric component of the thermoplastic material, may comprise or consist essentially of an elastomeric thermoplastic polyurethane hard segments and soft segments, such as an elastomeric thermoplastic polyurethane having repeating blocks of hard segments and repeating blocks of soft segments.

In aspects, one or more of the thermoplastic polyurethane elastomers can be produced by polymerizing one or more isocyanates with one or more polyols to produce copolymer chains having carbamate linkages (—N(CO)O—) as illustrated below in Formula 1, where the isocyanate(s) each preferably include two or more isocyanate (—NCO) groups per molecule, such as 2, 3, or 4 isocyanate groups per molecule (although, single-functional isocyanates can also be optionally included, e.g., as chain terminating units).

(Formula 1)

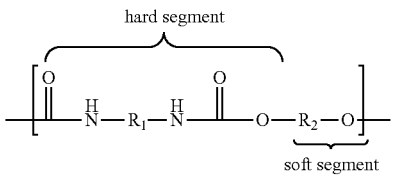

In these aspects, each $R_1$ and $R_2$ independently is an aliphatic or aromatic segment. Optionally, each R2 can be a hydrophilic segment.

Unless otherwise indicated, any of the functional groups or chemical compounds described herein can be substituted or unsubstituted. A "substituted" group or chemical compound, such as an alkyl, alkenyl, alkynyl, cycloalkyl, cycloalkenyl, aryl, heteroaryl, alkoxyl, ester, ether, or carboxylic ester refers to an alkyl, alkenyl, alkynyl, cycloalkyl, cycloalkenyl, aryl, heteroaryl, alkoxyl, ester, ether, or carboxylic ester group, has at least one hydrogen radical that is substituted with a non-hydrogen radical (i.e., a substituent). Examples of non-hydrogen radicals (or substituents) include, but are not limited to, alkyl, cycloalkyl, alkenyl, cycloalkenyl, alkynyl, ether, aryl, heteroaryl, heterocycloalkyl, hydroxyl, oxy (or oxo), alkoxyl, ester, thioester, acyl, carboxyl, cyano, nitro, amino, amido, sulfur, and halo. When a substituted alkyl group includes more than one non-hydrogen radical, the substituents can be bound to the same carbon or two or more different carbon atoms.

Additionally, the isocyanates can also be chain extended with one or more chain extenders to bridge two or more isocyanates. This can produce polyurethane copolymer chains as illustrated below in Formula 2, wherein $R_3$ includes the chain extender. As with each $R_1$ and $R_3$, each $R_3$ independently is an aliphatic or aromatic segment.

(Formula 2)

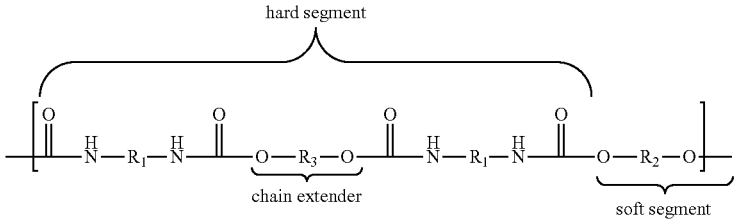

Each segment $R_1$, or the first segment, in Formulas 1 and 2 can independently include a linear or branched $C_{3-30}$ segment, based on the particular isocyanate(s) used, and can be aliphatic, aromatic, or include a combination of aliphatic portions(s) and aromatic portion(s). The term "aliphatic" refers to a saturated or unsaturated organic molecule that does not include a cyclically conjugated ring system having delocalized pi electrons. In comparison, the term "aromatic" refers to a cyclically conjugated ring system having delocalized pi electrons, which exhibits greater stability than a hypothetical ring system having localized pi electrons.

Each segment $R_1$ can be present in an amount of 5 percent to 85 percent by weight, from 5 percent to 70 percent by weight, or from 10 percent to 50 percent by weight, based on the total weight of the reactant monomers.

In aliphatic aspects (from aliphatic isocyanate(s)), each segment $R_1$ can include a linear aliphatic group, a branched aliphatic group, a cycloaliphatic group, or combinations thereof. For instance, each segment R1 can include a linear or branched $C_{3-20}$ alkylene segment (e.g., $C_{4-15}$ alkylene or $C_{6-10}$ alkylene), one or more $C_{3-8}$ cycloalkylene segments (e.g., cyclopropyl, cyclobutyl, cyclopentyl, cyclohexyl, cycloheptyl, or cyclooctyl), and combinations thereof.

Examples of suitable aliphatic diisocyanates for producing the polyurethane copolymer chains include hexamethylene diisocyanate (HDI), isophorone diisocyanate (IPDI), butylenediisocyanate (BDI), bisisocyanatocyclohexylmethane (HMDI), 2,2,4-tri methylhexamethylene diisocyanate (TMDI), bisisocyanatomethylcyclohexane, bisisocyanatomethyltricyclodecane, norbornane diisocyanate (N DI), cyclohexane diisocyanate (CHDI), 4,4'-dicyclohexylmethane diisocyanate (H12MDI), diisocyanatododecane, lysine diisocyanate, and combinations thereof.

In aromatic aspects (from aromatic isocyanate(s)), each segment $R_1$ can include one or more aromatic groups, such as phenyl, naphthyl, tetrahydronaphthyl, phenanthrenyl, biphenylenyl, indanyl, indenyl, anthracenyl, and fluorenyl. Unless otherwise indicated, an aromatic group can be an unsubstituted aromatic group or a substituted aromatic group, and can also include heteroaromatic groups. "Heteroaromatic" refers to monocyclic or polycyclic (e.g., fused bicyclic and fused tricyclic) aromatic ring systems, where one to four ring atoms are selected from oxygen, nitrogen, or sulfur, and the remaining ring atoms are carbon, and where the ring system is joined to the remainder of the molecule by any of the ring atoms. Examples of suitable heteroaryl groups include pyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl.

Examples of suitable aromatic diisocyanates for producing the polyurethane copolymer chains include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (N DI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some aspects, the copolymer chains are substantially free of aromatic groups.

In particular aspects, the polyurethane copolymer chains are produced from diisocyanates including HMDI, TDI, MDI, H12 aliphatics, and combinations thereof. For example, the coated fiber as described herein of the present disclosure can comprise one or more polyurethane copolymer chains that are produced from diisocynates, including HMDI, TDI, MDI, $H_{12}$ aliphatics, and combinations thereof.

In certain aspects, polyurethane chains which are crosslinked (e.g., partially crosslinked polyurethane copolymers which retain thermoplastic properties) or which can be crosslinked, can be used in accordance with the present disclosure. It is possible to produce crosslinked or crosslinkable polyurethane copolymer chains using multi-functional isocyanates. Examples of suitable triisocyanates for producing the polyurethane copolymer chains include TDI, HDI, and IPDI adducts with trimethyloylpropane (TMP), uretdiones (i.e., dimerized isocyanates), polymeric MDI, and combinations thereof.

Segment $R_3$ in Formula 2 can include a linear or branched $C_2$-$C_{10}$ segment, based on the particular chain extender polyol used, and can be, for example, aliphatic, aromatic, or polyether. Examples of suitable chain extender polyols for producing the polyurethane copolymer chains include ethylene glycol, lower oligomers of ethylene glycol (e.g., diethylene glycol, triethylene glycol, and tetraethylene glycol), 1,2-propylene glycol, 1,3-propylene glycol, lower oligomers of propylene glycol (e.g., dipropylene glycol, tripropylene glycol, and tetrapropylene glycol), 1,4-butylene glycol, 2,3-butylene glycol, 1,6-hexanediol, 1,8-octanediol, neopentyl glycol, 1,4-cyclohexanedimethanol, 2-ethyl-1,6-hexanediol, 1-methyl-1,3-propanediol, 2-methyl-1,3-propanediol, dihydroxyalkylated aromatic compounds (e.g., bis (2-hydroxyethyl) ethers of hydroquinone and resorcinol, xylene-a,a-diols, bis(2-hydroxyethyl) ethers of xylene-a,a-diols, and combinations thereof.

Segment $R_2$ in Formula 1 and 2 can include a polyether group, a polyester group, a polycarbonate group, an aliphatic group, or an aromatic group. Each segment $R_2$ can be present in an amount of 5 percent to 85 percent by weight, from 5 percent to 70 percent by weight, or from 10 percent to 50 percent by weight, based on the total weight of the reactant monomers.

Optionally, in some examples, the thermoplastic polyurethane elastomer is a thermoplastic polyurethane having a relatively high degree of hydrophilicity. For example, the thermoplastic polyurethane can be a thermoplastic polyether polyurethane in which segment $R_2$ in Formulas 1 and 2 includes a polyether group, a polyester group, a polycarbonate group, an aliphatic group, or an aromatic group, wherein the aliphatic group or aromatic group is substituted with one or more pendant groups having relatively greater degrees of hydrophilicity (i.e., relatively "hydrophilic" groups). The relatively "hydrophilic" groups can be selected from the group consisting of hydroxyl, polyether, polyester, polylactone (e.g., polyvinylpyrrolidone (PVP)), amino, carboxylate, sulfonate, phosphate, ammonium (e.g., tertiary and quaternary ammonium), zwitterion (e.g., a betaine, such as poly(carboxybetaine) (pCB) and ammonium phosphonates such as phosphatidylcholine), and combinations thereof. In such examples, this relatively hydrophilic group or segment of $R_2$ can form portions of the polyurethane backbone, or can be grafted to the polyurethane backbone as a pendant group. In some examples, the pendant hydrophilic group or segment can be bonded to the aliphatic group or aromatic group through a linker. Each segment $R_2$ can be present in an amount of 5 percent to 85 percent by weight, from 5 percent to 70 percent by weight, or from 10 percent to 50 percent by weight, based on the total weight of the reactant monomers.

In some examples, at least one $R_2$ segment of the thermoplastic polyurethane elastomer includes a polyether segment (i.e., a segment having one or more ether groups). Suitable polyethers include, but are not limited to, polyethylene oxide (PEO), polypropylene oxide (PPO), polytetrahydrofuran (PTHF), polytetramethylene oxide (PTmO), and combinations thereof. The term "alkyl" as used herein refers to straight chained and branched saturated hydrocarbon groups containing one to thirty carbon atoms, for example, one to twenty carbon atoms, or one to ten carbon atoms. The term Cn, means the alkyl group has "n" carbon atoms. For example, $C_4$ alkyl refers to an alkyl group that has 4 carbon atoms. $C_{1-7}$ alkyl refers to an alkyl group having a number of carbon atoms encompassing the entire range (i.e., 1 to 7 carbon atoms), as well as all subgroups (e.g., 1-6, 2-7, 1-5, 3-6, 1, 2, 3, 4, 5, 6, and 7 carbon atoms). Non-limiting examples of alkyl groups include, methyl, ethyl, n-propyl, isopropyl, n-butyl, sec-butyl (2-methylpropyl), t-butyl (1,1-dimethylethyl), 3,3-dimethylpentyl, and 2-ethylhexyl. Unless otherwise indicated, an alkyl group can be an unsubstituted alkyl group or a substituted alkyl group.

In some examples of the thermoplastic polyurethane elastomer, the at least one R2 segment includes a polyester segment. The polyester segment can be derived from the polyesterification of one or more dihydric alcohols (e.g., ethylene glycol, 1,3-propylene glycol, 1,2-propylene glycol, 1,4-butanediol, 1,3-butanediol, 2-methylpentanediol-1,5,diethylene glycol, 1,5-pentaned iol, 1,5-hexanediol, 1,2-dodecanediol, cyclohexanedimethanol, and combinations thereof) with one or more dicarboxylic acids (e.g., adipic acid, succinic acid, sebacic acid, suberic acid, methyladipic acid, glutaric acid, pimelic acid, azelaic acid, thiodipropionic acid and citraconic acid and combinations thereof). The polyester also can be derived from polycarbonate prepolymers, such as poly(hexamethylene carbonate) glycol, poly (propylene carbonate) glycol, poly(tetramethylene carbonate)glycol, and poly(nonanemethylene carbonate) glycol. Suitable polyesters can include, for example, polyethylene adipate (PEA), poly(1,4-butylene adipate), poly(tetramethylene adipate), poly(hexamethylene adipate), polycaprolactone, polyhexam ethylene carbonate, poly(propylene carbonate), poly(tetramethylene carbonate), poly (nonanemethylene carbonate), and combinations thereof.

In various aspects of the thermoplastic polyurethane elastomer, at least one $R_2$ segment includes a polycarbonate segment. The polycarbonate segment can be derived from the reaction of one or more dihydric alcohols (e.g., ethylene glycol, 1,3-propylene glycol, 1,2-propylene glycol, 1,4-butanediol, 1,3-butanediol, 2-methylpentanediol-1,5, diethylene glycol, 1,5-pentanediol, 1,5-hexanediol, 1,2-dodecanediol, cyclohexanedimethanol, and combinations thereof) with ethylene carbonate.

In various examples of the thermoplastic polyurethane elastomer, at least one $R_2$ segment can include an aliphatic group substituted with one or more groups having a relatively greater degree of hydrophilicity, i.e., a relatively "hydrophilic" group. The one or more relatively hydrophilic groups can be selected from the group consisting of hydroxyl, polyether, polyester, polylactone (e.g., polyvinylpyrrolidone), amino, carboxylate, sulfonate, phosphate, ammonium (e.g., tertiary and quaternary ammonium), zwitterion (e.g., a betaine, such as poly(carboxybetaine) (pCB) and ammonium phosphonates such as phosphatidylcholine), and combinations thereof. In some examples, the aliphatic group is linear and can include, for example, a C1_20 alkylene chain or a C1_20 alkenylene chain (e.g., methylene, ethylene, propylene, butylene, pentylene, hexylene, heptylene, octylene, nonylene, decylene, undecylene, dodecylene, tridecylene, ethenylene, propenylene, butenylene, pentenylene, hexenylene, heptenylene, octenylene, nonenylene, decenylene, undecenylene, dodecenylene, and tridecenylene). The term "alkylene" refers to a bivalent hydrocarbon. The term means the alkylene group has "n" carbon atoms. For example, $C_{1-6}$ alkylene refers to an alkylene group having, e.g., 1, 2, 3, 4, 5, or 6 carbon atoms. The term "alkenylene" refers to a bivalent hydrocarbon having at least one double bond.

In some cases, at least one R2 segment includes an aromatic group substituted with one or more relatively hydrophilic groups. The one or more hydrophilic groups can be selected from the group consisting of hydroxyl, polyether, polyester, polylactone (e.g., polyvinylpyrrolidone), amino, carboxylate, sulfonate, phosphate, ammonium (e.g., tertiary and quaternary ammonium), zwitterionic (e.g., a betaine, such as poly(carboxybetaine) (pCB) and ammonium phosphonate groups such as phosphatidylcholine), and combinations thereof. Suitable aromatic groups include, but are not limited to, phenyl, naphthyl, tetrahydronaphthyl, phenanthrenyl, biphenylenyl, indanyl, indenyl, anthracenyl, fluorenylpyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl groups, and combinations thereof.

In various aspects, the aliphatic and aromatic groups can be substituted with one or more pendant relatively hydrophilic and/or charged groups. In some aspects, the pendant hydrophilic group includes one or more (e.g., 2, 3, 4, 5, 6, 7, 8, 9, 10 or more) hydroxyl groups. In various aspects, the pendant hydrophilic group includes one or more (e.g., 2, 3, 4, 5, 6, 7, 8, 9, 10 or more) amino groups. In some cases, the pendant hydrophilic group includes one or more (e.g., 2, 3, 4, 5, 6, 7, 8, 9, 10 or more) carboxylate groups. For example, the aliphatic group can include one or more polyacrylic acid groups. In some cases, the pendant hydrophilic group includes one or more (e.g., 2, 3, 4, 5, 6, 7, 8, 9, 10 or more) sulfonate groups. In some cases, the pendant hydrophilic group includes one or more (e.g., 2, 3, 4, 5, 6, 7, 8, 9, 10 or more) phosphate groups. In some examples, the pendant hydrophilic group includes one or more ammonium groups (e.g., tertiary and/or quaternary ammonium). In other examples, the pendant hydrophilic group includes one or more zwitterionic groups (e.g., a betaine, such as poly (carboxybetaine) (pCB) and ammonium phosphonate groups such as a phosphatidylcholine group).

In some aspects, the $R_2$ segment can include charged groups that are capable of binding to a counterion to ionically crosslink the thermoplastic elastomer and form ionomers. In these aspects, for example, $R_2$ is an aliphatic or aromatic group having pendant amino, carboxylate, sulfonate, phosphate, ammonium, or zwitterionic groups, or combinations thereof.

In various cases when a pendant hydrophilic group is present, the pendant "hydrophilic" group is at least one polyether group, such as two polyether groups. In other cases, the pendant hydrophilic group is at least one polyester. In various cases, the pendant hydrophilic group is a polylactone group (e.g., polyvinylpyrrolidone). Each carbon atom of the pendant hydrophilic group can optionally be substituted with, e.g., a $C_{1-6}$ alkyl group. In some of these aspects, the aliphatic and aromatic groups can be graft polymeric groups, wherein the pendant groups are homopolymeric groups (e.g., polyether groups, polyester groups, polyvinylpyrrolidone groups).

In some aspects, the pendant hydrophilic group is a polyether group (e.g., a polyethylene oxide group, or a polyethylene glycol group), a polyvinylpyrrolidone group, a polyacrylic acid group, or combinations thereof.

As described herein, the thermoplastic polyurethane elastomer can be physically crosslinked through e.g., nonpolar or polar interactions between the urethane or carbamate groups on the polymers (the hard segments). In these aspects, component $R_1$ in Formula 1, and components $R_1$ and $R_3$ in Formula 2, form the portion of the polymer often referred to as the "hard segment", and component $R_2$ forms the portion of the polymer often referred to as the "soft segment". In these aspects, the soft segment can be covalently bonded to the hard segment. In some examples, the thermoplastic polyurethane elastomer having physically crosslinked hard and soft segments can be a hydrophilic thermoplastic polyurethane elastomer (i.e., a thermoplastic polyurethane elastomer including hydrophilic groups as disclosed herein).

In one aspect, prior to thermoforming, the thermoplastic polyurethane elastomer is an aromatic polyester thermoplastic elastomeric polyurethane or an aliphatic polyester thermoplastic elastomeric polyurethane having the following properties: (1) a glass transition temperature of from about 20 degrees Celsius to about −60 degrees Celsius; (2) a Taber Abrasion Resistance of from about 10 milligrams to about 40 milligrams as determined by ASTM D3389; (3) a Durometer Hardness (Shore A) of from about 60 to about 90 as determined by ASTM D2240; (4) a specific gravity of from about 0.80 g/cm$^3$ to about 1.30 g/cm$^3$ as determined by ASTM D792; (5) a melt flow index of about 2 grams/10 minutes to about 50 grams/10 minutes at 160 degrees Celsius using a test weight of 2.16 kilograms; (6) a melt flow rate greater than about 2 grams/10 minutes at 190 degrees Celsius or 200 degrees Celsius when using a test weight of 10 kilograms; and (7) a modulus of about 1 megapascal to about 500 megapascals.

Commercially available thermoplastic polyurethane elastomers having greater hydrophilicity suitable for the present use include, but are not limited to those under the tradename "TECOPHILIC", such as TG-500, TG-2000, SP-80A-150, SP-93A-100, SP-60D60 (Lubrizol, Countryside, IL), "ESTANE" (e.g., 58238, T470A; Lubrizol, Countryside, IL), and "ELASTOLLAN" (e.g., 9339, 1370A; BASF).

In various aspects, the thermoplastic polyurethane elastomer can be partially covalently crosslinked, as previously described herein.

Example Thermoplastic Styrenic Copolymer Elastomers

In certain aspects, the thermoplastic elastomer is a thermoplastic elastomeric styrenic copolymer. Examples of these copolymers include, but are not limited to, styrene butadiene styrene (SBS) block copolymer, a styrene ethylene/butylene styrene (SEBS) resin, a polyacetal resin (POM) a styrene acrylonitrile resin (SAN), or a blend, alloy, or compound thereof. Exemplary commercially available thermoplastic elastomeric styrenic copolymers include MONOPRENE IN5074, SP066070, and SP16975 (Teknor Apex, Pawtucket, RI, USA), which are styrene ethylene/butylene styrene (SEBS) resins. In some aspects, blends, alloys, and compounds should be melt compatible or can be compatibilized with additives, oils, or grafted chemical moieties in order to achieve miscibility.

In one aspect, the thermoplastic elastomeric styrenic copolymer includes at least one block as illustrated below in Formula 3:

(Formula 3)

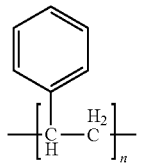

In another aspect, the thermoplastic elastomeric styrenic copolymer can be an SBS block copolymer comprising a first polystyrene block (block m of Formula 4), a polybutadiene block (block o of Formula 4), and a second polystyrene block (block p of Formula 4), wherein the SBS block copolymer has the general structure shown in Formula 4 below:

(Formula 4)

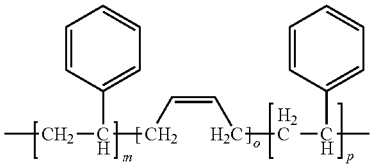

In another aspect, the thermoplastic elastomeric styrenic copolymer can be an SEBS block copolymer comprising a first polystyrene block (block x of Formula 5), a polyolefin block (block y of Formula 5), wherein the polyolefin block comprises alternating polyethylene blocks (block v of Formula 5) and polybutylene blocks (block w of Formula 4), and a second polystyrene block (block z of Formula 5), as seen in Formula 5 below:

(Formula 5)

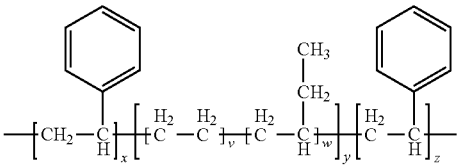

In one aspect, SEBS polymers have a density from about 0.88 grams per cubic centimeter to about 0.92 grams per cubic centimeter. In a further aspect, SEBS polymers can be as much as 15 to 25 percent less dense than cross-linked rubbers, cross-linked polyurethanes, and thermoplastic polyurethane materials. In a further aspect, a less dense coating composition offers weight savings and per part cost savings for the same material of volume employed while achieving a similar performance.

Reference to "a chemical compound" refers to one or more molecules of the chemical compound, rather than being limited to a single molecule of the chemical compound. Furthermore, the one or more molecules can or cannot be identical, so long as they fall under the category of the chemical compound. Thus, for example, "a polyamide" is interpreted to include one or more polymer molecules of the polyamide, where the polymer molecules can or cannot be identical (e.g., different molecular weights and/or isomers).

The terms "at least one" and "one or more of" an element are used interchangeably, and have the same meaning that includes a single element and a plurality of the elements, and can also be represented by the suffix "(s)" at the end of the element. For example, "at least one polyamide", "one or more polyamides", and "polyamide(s)" can be used interchangeably and have the same meaning.

Unless otherwise specified, temperatures referred to herein are determined at standard atmospheric pressure (i.e., 1 ATM).

Property Analysis and Characterization Procedures

Evaluation of various properties and characteristics described herein are by various testing procedures as described below.

Sample Coefficient of Friction. The static or dynamic coefficient of friction (COF) of a textile or plaque sample can be determined using test method ASTM D1894. In this method, a sample is cut to size and mounted on the sled, and a 100 gram weight plate is placed on the sled. During the test, the weighted sled is pulled across a test surface of the material being tested. For example, static and dynamic wet and dry COF may be determined by pulling the sled across a concrete surface to determine the COF of the sample and concrete. The coefficient of friction of the sample against that surface is captured by recording the normal force (100 grams plus sled weight) and measuring the applied force required to drag the sled across the test surface. The coefficient of friction (COF) is then calculated from the ratio of the two forces. Dry COF is determined by testing a dry sample against a dry testing surface, and wet COF is determined by testing a sample wetted with water by soaking it in room temperature water for 10 minutes against a test surface wetted with room temperature water.

Textile-Ball Coefficient of Friction Test. The static and dynamic coefficient of friction (COF) of a sample prepared using the Component Sampling Procedure or the Textile Sampling Procedure described below against a sample from a panel of a "MERLIN" football (Nike Inc., Beaverton, OR, USA) can be determined using a modified version of test method ASTM D1894 as described for the Sample Coefficient of Friction. In this method, the sample is cut to size and mounted on an acrylic substrate, and the ball material is cut to size and mounted on the sled. Once the ball material has been mounted on the sled, the sled has a contact footprint of 3.9 inches by 1 inch, and a weight of approximately 0.402 kilograms. During the test, the sample and ball material are positioned with the external-facing surface of the ball material contacting the surface of the sample which is intended to form the external-facing surface of an article of footwear, and the sled is pulled across the sample. Dry samples and dry ball material are used to determine the static or dynamic dry COF. To determine the static or dynamic wet COF, the sample and the ball material are both soaked in room temperature water for 10 minutes immediately prior to testing. Each measurement is repeated at least 3 times, and the results of the runs are averaged.

Melting and Glass Transition Temperature Test. The melting temperature and/or glass transition temperature are determined for a sample prepared according to Material Sampling Procedure described below, using a commercially available Differential Scanning calorimeter ("DSC") in accordance with ASTM D3418-97. Briefly, a 10-60 milligram sample is placed into an aluminum DSC pan and then the lid is sealed with a crimper press. The DSC is configured to scan from −100 degrees Celsius to 225 degrees Celsius with a 20 degree Celsius/minute heating rate, holding at 225 degrees Celsius for 2 minutes, and then cooling down to 25 degrees Celsius at a rate of −20 degrees Celsius/minute. The DSC curve created from this scan is then analyzed using standard techniques to determine the glass transition temperature and the melting temperature. Melting enthalpy is calculated by integrating the melting endotherm and normalizing by the mass of the sample. Crystallization enthalpy upon cooling is calculated by integrating the cooling endotherm and normalizing by the mass of the sample.

Deformation Temperature Test. The Vicat softening temperature is determined for a sample prepared according to Material Sampling Procedure or the Component Sampling Procedure described below, according to the test method detailed in ASTM Tm D1525-09 Standard Test Method for Vicat Softening Temperature of Plastics, preferably using Load A and Rate A. Briefly, the Vicat softening temperature is the temperature at which a flat-ended needle penetrates the specimen to the depth of 1 millimeter under a specific load. The temperature reflects the point of softening expected when a material is used in an elevated temperature application. It is taken as the temperature at which the specimen is penetrated to a depth of 1 millimeter by a flat-ended needle with a 1 millimeter$^2$ circular or square cross-section. For the Vicat A test, a load of 10 Newtons (N) is used, whereas for the Vicat B test, the load is 50 Newtons. The test involves placing a test specimen in the testing apparatus so that the penetrating needle rests on its surface at least 1 millimeter from the edge. A load is applied to the specimen per the requirements of the Vicat A or Vicat B test. The specimen is then lowered into an oil bath at 23 degrees Celsius. The bath is raised at a rate of 50 degrees Celsius or 120 degrees Celsius per hour until the needle penetrates 1 millimeter. The test specimen must be between 3 and 6.5 millimeters thick and at least 10 millimeters in width and length. No more than three layers can be stacked to achieve minimum thickness.

Melt Flow Index Test. The melt flow index is determined for a sample prepared according to the Material Sampling Procedure described below according to the test method detailed in ASTM D1238-13 Standard Test Method for Melt Flow Rates of Thermoplastics by Extrusion Plastometer, using Procedure A described therein. Briefly, the melt flow index measures the rate of extrusion of thermoplastics through an orifice at a prescribed temperature and load. In the test method, approximately 7 grams of the material is loaded into the barrel of the melt flow apparatus, which has been heated to a temperature specified for the material. A weight specified for the material is applied to a plunger and the molten material is forced through the die. A timed extrudate is collected and weighed. Melt flow index values are calculated in g/10 min for a given applied load and applied temperature. As described in ASTM D1238-13, melt flow index may be determined at 160 degrees Celsius using a weight of 2.16 kg, or at 200 degrees Celsius using a weight of 10 kg.

Molten Polymer Viscosity Test. The test is conducted using 2 millimeter plaques or films prepared according to the Plaque or Film Sampling Procedure described below. A circular die is used to cut 50 millimeter specimen discs of from the plaque or film. Test specimens are mounted on a 50 millimeter diameter aluminum parallel plate on an ARES-G2 (displacement controlled) rheometer. The top plate is lowered so that the test specimens are in contact with both disc surfaces under a defined normal force load and the stage is heated to 210 degrees Celsius. Samples are equilibrated until molten, for a defined dwell time of minutes, and oscillatory shear frequency sweeps are applied at low strain amplitudes to gather rate-dependent data. The ratio of the applied shear stress required to generate the oscillatory motion at a given shear frequency rate yields the measured viscosity value. Shear rate-dependent viscosity data can be gathered from 0.1 reciprocal seconds to 1000 reciprocal seconds.

Plaque Modulus Test. The modulus for a sample prepared according to the Plaque or Film Sampling Procedure described below is determined according to the test method detailed in ASTM D412-98 Standard Test Methods for Vulcanized Rubber and Thermoplastic Rubbers and Thermoplastic Elastomers-Tension, with the following modifications. The sample dimension is the ASTM D412-98 Die C, and the sample thickness used is 2.0 millimeters plus or minus 0.5 millimeters. The grip type used is a pneumatic grip with a metal serrated grip face. The grip distance used is 75 millimeters. The loading rate used is 500 millimeters/minute. The modulus (initial) is calculated by taking the slope of the stress (MPa) versus the strain in the initial linear region. This test may also be used to determine other tensile properties such as break strength, strain to break, load at 100 percent strain, toughness, stiffness, tear strength, and the like.

Yarn Denier and Thickness Test. To determine denier, a sample of yarn is prepared according to the Yarn Sampling Procedure described below. A known length of the yarn sample and its corresponding weight are measured. This is converted to grams per 9000 meters of yarn. To determine the thickness of a coated yarn, the yarn is first cut with a razor and observed under a microscope, where coating thickness relative to core yarn diameter is determined to scale.

Yarn Modulus, Tenacity, and Elongation Test. The modulus for a yarn is determined for a sample prepared according to the Yarn Sampling Procedure described above, and tested according to the test method detailed in EN ISO 2062 (Textiles-Yarns from Packages)—Determination of Single-End Breaking Force and Elongation at Break Using Constant Rate of Extension (CRE) Tester. The following modifications to the test method are used. Five test specimens are prepared with a sample length of 600 millimeters. The equipment used is an Instron Universal Testing System. Instron Pneumatic cord and Thread Grips or similar pneumatic grips are installed, with a grip distance of 250 millimeters. Grip distance is set to 145+1 millimeter and gauge length is set at 250+2 millimeters when using Instron Pneumatic Cord and Thread Grips. The pre-loading is set to 5 grams and the loading rate used is 250 millimeters/minute. The modulus (initial) is calculated by taking the slope of the stress (MPa) versus the strain in the initial linear region. Maximum tensile force value is recorded. Tenacity and elongation of the yarn sample are determined according to the test method detailed in EN ISO 2062 with the pre-load set to 5 grams. Elongation is recorded at the maximum tensile force value applied prior to breaking. In some aspects, tenacity is calculated as the ratio of load required to break the specimen to the linear density of the specimen.

Specific Gravity Test. The specific gravity (SG) is determined according to the test method detailed in ASTM D792 using volume displacement. For instance, SG is measured for samples taken using the Plaque Sampling Procedure, or the Component Sampling Procedure, using a digital balance or a Densicom Tester (Qualitest, Plantation, Florida, USA). Each sample is weighed (g) and then is submerged in a distilled water bath (at 22 degrees Celsius plus or minus 2 degrees Celsius). To avoid errors, air bubbles on the surface of the samples are removed, e.g., by wiping isopropyl alcohol on the sample before immersing the sample in water, or using a brush after the sample is immersed. The weight of the sample in the distilled water is recorded. The specific gravity is calculated with the following formula:

$$S.G. = \frac{\text{Weight of the sample in air (g)}}{\text{Weight of sample in air (g)} - \text{WEight of sample in water (g)}}$$

Durometer Hardness Test. The hardness of a material can be determined for a sample according to the test method detailed in ASTM D-2240 Durometer Hardness, using a Shore A scale.

Yarn Shrinkage Test. The free-standing shrinkage of yarns can be determined by the following method. A yarn sample is prepared according to the Yarn Sampling Procedure described below, and is cut to a length of approximately 30 millimeters with minimal tension at approximately room temperature (e.g., 20 degrees Celsius). The cut sample is placed in a 50 degrees Celsius or 70 degrees Celsius oven for 90 seconds. The sample is removed from the oven and measured. The percentage of shrink is calculated using the pre- and post-oven measurements of the sample by dividing the post-oven measurement by the pre-oven measurement, and multiplying by 100.

Stoll Abrasion Test. Abrasion resistance, including abrasion resistance simulating footwear upper scuffing, can be measured using the Stoll abrasion test, using samples prepared according to the Component Sampling Procedure, the Plaque or Film Sampling Procedure, or the Textile Sampling Procedure described below. The minimum number of samples for Stoll abrasion testing is 3. Samples used herein were hand-cut or die-cut into circles having a 112 millimeter diameter. The Stoll abrasion test is described more fully in ASTM D3886 and can be performed on the Atlas Universal Wear Tester. In the Stoll abrasion test, an abrading medium is moved over the stationary, mounted test sample and the visual appearance of the sample is monitored. The Stoll abrasion test is performed under pressure to simulate wear under normal usage.

DIN Abrasion Test. Samples are prepared according to the Component Sampling Procedure, the Plaque or Film Sampling Procedure, or the Textile Sampling Procedure described below. Abrasion loss is tested on cylindrical samples with a diameter of 16±0.2 millimeters and a minimum thickness of 6 millimeters, cut using an ASTM standard hole drill. The abrasion loss is measured using Method B of ASTM D 5963-97a on a Gotech GT-7012-D abrasion test machine. The tests are performed as 22 degrees Celsius with an abrasion path of 40 meters. The Standard Rubber #1 used in the tests has a density of 1.336 grams per cubic centimeter ($g/cm^3$). The smaller the abrasion loss volume, the better the abrasion resistance.

Water Penetration Test. Water penetration for a sample is determined as follows, using a sample prepared according to the Component Sampling Procedure, the Plaque or Film Sampling Procedure, or the Textile Sampling Procedure described below. The specimen to be tested is mounted on a support base with a surface at a 45 degree angle to the horizontal. The support base includes a 152 millimeter diameter specimen holder inner ring. A specimen is allowed to equilibrate in the laboratory environment for at least 2 hours prior to testing. Test specimens are cut into 220 millimeter diameter circles. Thicker or harder materials such as leather or stiff synthetic leather will have 3 notches cut into the outer edge of the sample. Specimens may be hand cut or die cut. Test specimens for softer materials are cut to the same size, with length direction marked on the test specimens. Backing paper is prepared from white or off-white paper towels, coffee filters, or similar thin, absorbent papers. Backing paper is also cut into 220 millimeter diameter circles. One backing paper is prepared per test specimen and backing paper is not reused. The backing paper and a specimen are placed in a sample fixture, which is in turn placed in a spray testing device. The sample length direction should be parallel with the water flow direction. A funnel is adjusted to a height of 6 inches (152.4 millimeters) between a spray nozzle and the test specimen. The spray nozzle must be over the center of the test specimen. 250±2 milliliters of distilled water are added to the funnel, which causes water to spray onto the test specimen. Within 10 seconds of spraying ending, the top surface is evaluated for water repellency. After the top surface is evaluated, the sample fixture is removed from the support base and the backing paper is evaluated to determine if water penetrated through the sample. Water penetration is reported after visual assessment and samples are rated as "pass" or "fail" according to the degree of wetting. If no sticking or wetting of the top surface is observed, if slight random sticking or wetting of the top surface is observed, or if wetting of the top surface is observed at spray points, the sample is considered to pass. Further wetting beyond the spray points and/or including the back surface indicates the sample has failed the water penetration test.

Textile-Ball Impact Test. Test samples of textiles are prepared according to the Component Sampling Procedure or the Textile Sampling Procedure described below. A 10 inch by 8 inch test sample of the textile is mounted on the outer surface on a metal cylinder having a 10 inch circumference. The test sample and cylinder are mounted on the swinging arm of a robot, where the swinging arm is swung at a rate of 50 miles per hour, and impacts the equator of a stationary ball. The ball used is a regulation size Nike "MERLIN" football inflated to 0.80 bar. A high speed video camera is used to record the ball position immediately following the impact. Using the position in space and rotation of the ball across multiple frames of the images recorded by the high-speed video camera, software is then used to calculate the velocity and spin rate of the ball immediately after impact. Each measurement is repeated at least 3 times, and the results of the runs are averaged.

Upper-Ball Impact Test. A whole men's size 10.5 football boot, or the upper of a men's size 10.5 football boot, is mounted on the swinging arm of a robot, and positioned so the ball impacts the boot on the medial side of the vamp, on or near the laces (when the boot includes a lacing structure), and the upper impacts the equator of the ball when the swinging arm of the robot is swung at a rate of 50 miles per hour. The ball used is a regulation size Nike "MERLIN" football inflated to 0.80 bar. A high speed video camera is used to record the ball position immediately following the impact. Using the position in space and rotation of the ball across multiple frames of the images recorded by the high-speed video camera, software is then used to calculate the velocity and spin rate of the ball immediately after impact. Each measurement is repeated at least 3 times, and the results of the runs are averaged.

Sampling Procedures

Using the Tests described above, various properties of the materials disclosed herein and articles formed therefrom can be characterized using samples prepared with the following sampling procedures:

Material Sampling Procedure. The Material Sampling Procedure can be used to obtain a neat sample of a polymeric composition or of a polymer, or, in some instances, a sample of a material used to form a polymeric composition or a polymer. The material is provided in media form, such as flakes, granules, powders, pellets, and the like. If a source of the polymeric material or polymer is not available in a neat form, the sample can be cut from a component or element containing the polymeric material or polymer, such as a composite element or a sole structure, thereby isolating a sample of the material.

Plaque or Film Sampling Procedure. A sample of a polymeric composition or a polymer is prepared. A portion of the polymer or polymeric composition is then molded into a film or plaque sized to fit the testing apparatus. For example, when using a Ross flexing tester, the plaque or film sample is sized to fit inside the Ross flexing tester used, the sample having dimensions of about 15 centimeters (cm) by 2.5 centimeters (cm) and a thickness of about 1 millimeter (mm) to about 4 millimeters (mm) by thermoforming the polymeric composition or polymer in a mold. For a plaque sample of a polymer, the sample can be prepared by melting the polymer, charging the molten polymer into a mold, re-solidifying the polymer in the shape of the mold, and removing the solidified molded sample from the mold. Alternatively, the sample of the polymer can be melted and then extruded into a film which is cut to size. For a sample of a polymeric composition, the sample can be prepared by blending together the ingredients of the polymeric composition, melting the thermoplastic ingredients of the polymeric composition, charging the molten polymeric composition into a mold, resolidifying the polymeric composition in the shape of the mold, and removing the solidified molded sample from the mold. Alternatively, the sample of the polymer material can be prepared by mixing and melting the ingredients of the polymeric composition, and then the molten polymeric composition can be extruded into a film which is cut to size. For a film sample of a polymer or polymeric composition, the film is extruded as a web or sheet having a substantially constant film thickness for the film (within ±10 percent of the average film thickness) and cooled to solidify the resulting web or sheet. A sample having a surface area of 4 square centimeters is then cut from the resulting web or sheet. Alternatively, if a source of the film material is not available in a neat form, the film can be cut from a substrate of a footwear component, or from a backing substrate of a co-extruded sheet or web, thereby isolating the film. In either case, a sample having a surface area of 4 square centimeters is then cut from the resulting isolated film.

Component Sampling Procedure. This procedure can be used to obtain a sample of a material from a component of an article of footwear, an article of footwear, a component of an article of apparel, an article of apparel, a component of an article of sporting equipment, or an article of sporting equipment, including a sample of a polymeric composition or of a textile, or a portion of a textile, such as a thermoformed network. A sample including the material in a non-wet state (e.g., at 25 degrees Celsius and 20 percent relative humidity) is cut from the article or component using a blade. If the material is bonded to one or more additional materials, the procedure can include separating the additional materials from the material to be tested. For example, to test a material on a ground-facing surface of sole structure, the opposite surface can be skinned, abraded, scraped, or otherwise cleaned to remove any adhesives, yarns, fibers, foams, and the like which are affixed to the material to be tested. The resulting sample includes the material and may include any additional materials bonded to the material.

The sample is taken at a location along the article or component that provides a substantially constant material thickness for the material as present on the article or component (within plus or minus 10 percent of the average material thickness), such as, for an article of footwear, in a forefoot region, midfoot region, or a heel region of a ground-facing surface. For many of the test protocols described above, a sample having a surface area of 4 square centimeters ($cm^2$) is used. The sample is cut into a size and shape (e.g., a dogbone-shaped sample) to fit into the testing apparatus. In cases where the material is not present on the article or component in any segment having a 4 square centimeter surface area and/or where the material thickness is not substantially constant for a segment having a 4 square centimeter surface area, sample sizes with smaller cross-sectional surface areas can be taken and the area-specific measurements are adjusted accordingly.

Yarn Sampling Procedure. Yarn to be tested is stored at room temperature (20 degrees Celsius to 24 degrees Celsius) for 24 hours prior to testing. The first 3 meters of material are discarded. A sample yarn is cut to a length of approximately 30 millimeters with minimal tension at approximately room temperature (e.g., 20 degrees Celsius).

Textile Sampling Procedure. A textile to be tested is stored at room temperature (20 degrees Celsius to 24 degrees Celsius) for 24 hours prior to testing. The textile sample is cut to size as dictated by the test method to be used, with minimal tension at approximately room temperature (e.g., 20 degrees Celsius).

Example Aspects

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: A knitted component having a first surface and an opposite second surface, the first surface of the knitted component comprising: first areas having a first coefficient of friction, the first areas comprising a first yarn having a core and a coating, the coating at least partially surrounding the core; and second areas having a second coefficient of friction that is different than the first coefficient of friction, the second areas comprising a second yarn, wherein the first areas form an alternating pattern with the second areas such that the first areas are 40% to 80% of a total surface area of the first surface.

Clause 2: The knitted component according to clause 1, wherein the coating comprises a thermoplastic elastomer.

Clause 3: The knitted component according to any of clauses 1-2, wherein a first area of the first areas comprises a thermoformed network of interlooped yarns comprising the core and the coating, wherein the coating consolidates the thermoformed network of interlooped yarns by surrounding at least a portion of the core and occupying at least a portion of spaces between yarns in the thermoformed network of interlooped yarn.

Clause 4: The knitted component according to any of clauses 1-3, wherein the first coefficient of friction is greater than the second coefficient of friction.

Clause 5: The knitted component according to any of clauses 1-4, wherein the first coefficient of friction and the second coefficient of friction are dynamic coefficients of friction.

Clause 6: The knitted component according to any of clauses 1-5, wherein the second yarn does not include the coating.

Clause 7: The knitted component according to any of clauses 1-6, wherein the alternating pattern is a concentric pattern.

Clause 8: The knitted component according to any of clauses 1-7, wherein a first area of the first areas and a second area of the second areas are consecutive in the alternating pattern, wherein a boundary between the first area and second area is curvilinear.

Clause 9: The knitted component according to any of clauses 1-8, wherein a first area of the first areas and a second area of the second areas are consecutive in the alternating pattern, wherein a boundary between the first area and second area is linear.

Clause 10: The knitted component of any of clauses 1-9, wherein a first area of the first areas and a second area of the second areas are consecutive in the alternating pattern, wherein a first raised portion of the first surface continuously extends across the first area and the second area in a first direction.

Clause 11: A knitted article of footwear upper having an external-facing surface portion and an opposite internal-facing surface portion, the external-facing surface comprising: first areas having a first coefficient of friction, the first areas comprising a first yarn; and second areas having a second coefficient of friction that is different than the first coefficient of friction, the second areas comprising a second yarn, wherein the first areas form a first alternating pattern with the second areas in a first region of the external-facing portion such that the first areas are 40% to 80% of a total surface area of the external-facing surface portion in the first region.

Clause 12: The knitted article of footwear upper of clause 11, wherein the first areas form a second alternating pattern with the second areas in a second region of the external-facing portion such that the first areas are 40% to 80% of a total surface area of the external-facing surface portion in the second region.

Clause 13: The knitted article of footwear upper of clause 12, wherein the first region is on a medial portion of the knitted article of footwear upper and the second region is on a lateral portion of the knitted article of footwear upper.

Clause 14: The knitted article of footwear upper of any of clauses 11-13, wherein the first alternating pattern is a concentric pattern.

Clause 15: The knitted article of footwear upper of any of clauses 11-13, wherein the first alternating pattern is comprised of at least one of a curvilinear boundary between a first area of the first areas and a second area of the second areas or a linear boundary between the first area of the first areas and the second area of the second areas.

Clause 16: The knitted article of footwear upper of any of clauses 12-15, wherein a first area of the first areas, comprises a thermoformed network of interlooped yarns each having a core, such that a thermoplastic elastomer consolidates the interlooped yarns by surrounding at least a portion of the core and occupying at least a portion of spaces between yarns in the thermoformed network of interlooped yarn.

Clause 17: The knitted article of footwear upper of any of clauses 11-16, wherein the first region extends across at least a portion of a toe area of the knitted article of footwear upper.

Clause 18: The knitted article of footwear upper of any of clauses 11-16, wherein the first region extends across at least a portion of a toe area of the knitted article of footwear upper and at least one of a medial side and a lateral side of the knitted article of footwear upper.

Clause 19: A method of manufacturing a knitted component having a first surface and an opposite second surface, the method comprising: knitting a first yarn and a second yarn into the knitted component; and thermoforming the first surface of the knitted component, wherein the first surface of the knitted component comprises: first areas having a first coefficient of friction, the first areas comprising a thermoformed network of interlooped yarns each having a core, such that a thermoplastic elastomer consolidates the interlooped yarns by surrounding at least a portion of each core and occupying at least a portion of spaces between yarns in the thermoformed network of interlooped yarn, and second areas having a second coefficient of friction that is different than the first coefficient of friction, the second areas comprising a second yarn, wherein the first areas form an alternating pattern with the second areas such that the first areas are 40% to 80% of a total surface area of the first surface.

Clause 20: The method of clause 19, wherein thermoforming the first surface further comprises molding the first surface with one or more raised portions of the first surface, the one or more raised portions extending across a plurality of the first areas and a plurality of the second areas.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

While specific elements and steps are discussed in connection to one another, it is understood that any element and/or steps provided herein is contemplated as being combinable with any other elements and/or steps regardless of explicit provision of the same while still being within the scope provided herein. Since many possible aspects may be made of the disclosure without departing from the scope thereof, it is to be understood that all matter herein set forth or shown in the accompanying drawings is to be interpreted as illustrative and not in a limiting sense.

What is claimed is:

1. A knitted component comprising:

a first surface and an opposite second surface, the first surface of the knitted component comprising:

first areas having a first coefficient of friction, the first areas comprising a thermoformed network of interlooped yarns comprising a first yarn having a core and a thermoformed thermoplastic polymeric composition, wherein the thermoformed thermoplastic polymeric composition consolidates the thermoformed network of interlooped yarns by surrounding at least a portion of the core and occupying at least a portion of spaces between the yarns in the thermoformed network of interlooped yarns; and second areas having a second coefficient of friction that is different than the first coefficient of friction, the second areas comprising a second yarn, the second yarn being different from the first yarn, wherein the first coefficient of friction is greater than the second coefficient of friction, wherein the second coefficient of friction of the second areas is within a range from about 15% to about 60% less than the first coefficient of friction of the first areas, wherein the second surface comprises a plurality of third areas comprising a third yarn, and wherein at least a portion of the thermoformed thermoplastic polymeric composition extends completely from the first surface into the second surface.

2. The knitted component of claim 1, wherein the thermoformed thermoplastic polymeric composition comprises a thermoplastic elastomer.

3. The knitted component of claim 1, wherein the first coefficient of friction and the second coefficient of friction are dynamic coefficients of friction.

4. The knitted component of claim 1, wherein the second yarn does not include the thermoplastic polymeric composition of the first yarn.

5. The knitted component of claim 1, wherein the first areas form an alternating pattern with the second areas, and wherein the alternating pattern is a concentric pattern such that the first areas and the second areas are coaxial and share a common center.

6. The knitted component of claim 5, wherein a first area of the first areas and a second area of the second areas are consecutive in the alternating pattern, wherein a boundary between the first area and the second area is curvilinear.

7. The knitted component of claim 5, wherein a first area of the first areas and a second area of the second areas are consecutive in the alternating pattern, wherein a boundary between the first area and the second area is linear.

8. The knitted component of claim 5, wherein the first surface comprises a plurality of raised elements that continuously extends across the first area and the second area, and wherein at least some of the plurality of raised elements of the first surface are part of the thermoformed network of interlooped yarns.

9. A knitted article of footwear upper having an external-facing surface portion and an opposite internal-facing surface portion, the external-facing surface portion comprising: first areas having a first coefficient of friction, the first areas comprising a thermoformed network of interlooped yarns comprising a first yarn, the first yarn comprising a thermoplastic elastomer; and second areas having a second coefficient of friction, the second areas comprising a second yarn, the second yarn being different from the first yarn, wherein the first coefficient of friction is greater than the second coefficient of friction, wherein the second coefficient of friction of the second areas is within a range from about 20% to about 50% less than the first coefficient of friction of the first areas; wherein the second surface comprises a plurality of third areas comprising a third yarn, and wherein at least a portion of the thermoformed thermoplastic elastomer extends completely from the external-facing surface portion into the internal-facing surface portion.

10. The knitted article of footwear upper of claim 9, wherein the first areas and the second areas form an alternating pattern on the external-facing surface portion such that the first areas are 40% to 80% of a total surface area of the external-facing surface portion.

11. The knitted article of footwear upper of claim 9, wherein a first region is on a medial portion of the knitted article of footwear upper and a second region is on a lateral portion of the knitted article of footwear upper.

12. The knitted article of footwear upper of claim 10, wherein the alternating pattern is a concentric pattern.

13. The knitted article of footwear upper of claim 12, wherein the alternating pattern comprises at least one of a curvilinear boundary between a first area of the first areas and a second area of the second areas or a linear boundary between the first area of the first areas and the second area of the second areas.

14. The knitted article of footwear upper of claim 9, wherein a first area of the first areas comprises a thermoformed network of interlooped yarns each having a core and the thermoplastic elastomer that consolidates the interlooped yarns by surrounding at least a portion of the core and occupying at least a portion of spaces between yarns in the thermoformed network of interlooped yarns, wherein the thermoformed network of interlooped yarns forms a skin that is water-resistant.

15. The knitted article of footwear upper of claim 11, wherein the first region extends across at least a portion of a toe area of the knitted article of footwear upper.

16. The knitted article of footwear upper of claim 11, wherein the first region extends across at least a portion of a toe area of the knitted article of footwear upper and at least one of a medial side and a lateral side of the knitted article of footwear upper.

17. A method of manufacturing a knitted component having a first surface and an opposite second surface, the method comprising: knitting a first yarn and a second yarn into the knitted component, the first yarn comprising a thermoplastic elastomer, the second yarn being different from the first yarn; and thermoforming the first surface of the knitted component, wherein the first surface of the knitted component comprises: first areas having a first coefficient of friction, the first areas comprising a thermoformed network of interlooped yarns each having a core, such that the thermoplastic elastomer of a coating of the first yarn consolidates the interlooped yarns by surrounding at least a portion of each core and occupying at least a portion of spaces between yarns in the thermoformed network of interlooped yarns, and second areas having a second coefficient of friction that is different than the first coefficient of friction, the second areas comprising the second yarn, wherein the first coefficient of friction is greater than the second coefficient of friction, and wherein the second coefficient of friction of the second areas is within a range from about 20% to about 60% less than the first coefficient of friction of the first areas; wherein the second surface comprises a plurality of third areas comprising a third yarn, wherein at least a portion of the thermoplastic elastomer extends completely from the first surface into the second surface.

18. The method of claim 17, wherein thermoforming the first surface further comprises molding the first surface to form a plurality of raised elements on the first surface, wherein the plurality of raised elements are part of the thermoformed network of interlooped yarns.

19. The knitted component of claim 1, wherein the thermoplastic polymeric composition comprises a thermoplastic elastomer that is melted and re-solidified to form the thermoformed network of interlooped yarns associated with the first coefficient of friction.

20. The knitted component of claim 1, wherein the third yarn comprises an elastic material, and wherein the third yarn is absent from the first surface of the knitted component.

21. The knitted component of claim 1, wherein the third yarn comprises an elastic polyurethane material.

22. The knitted article of footwear upper of claim 9, wherein the third yarn comprises an elastic polyurethane material.

23. The method of claim 17, wherein the third yarn comprises an elastic polyurethane material.

24. The knitted component of claim 20, wherein the third yarn increases resilience of the knitted component at the second surface.

* * * * *